US006384786B2

(12) United States Patent
Ito et al.

(10) Patent No.: US 6,384,786 B2
(45) Date of Patent: May 7, 2002

(54) ANTENNA DEVICE AND COMMUNICATION APPARATUS

(75) Inventors: Shigekazu Ito, Sagamihara; Kazunari Kawahata, Machida, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/760,217

(22) Filed: Jan. 11, 2001

(30) Foreign Application Priority Data

Jan. 13, 2000 (JP) ..... 2000-004648
Oct. 4, 2000 (JP) ..... 2000-305093

(51) Int. Cl.[7] ..... H01Q 1/38
(52) U.S. Cl. ..... 343/700 MS; 343/702
(58) Field of Search ..... 343/700 MS, 702, 343/829, 846, 853; H01Q 1/24, 1/36, 1/38

(56) References Cited

U.S. PATENT DOCUMENTS 4,973,972 A 11/1990 Huang ..... 343/700 MS
5,537,123 A * 7/1996 Mandai et al. ..... 343/700 MS
5,959,582 A * 9/1999 Kawahata et al. ... 343/700 MS
6,040,806 A * 3/2000 Kushihi et al. ..... 343/853
6,118,405 A 9/2000 Mckinnon et al. ... 343/700 MS
6,140,968 A * 10/2000 Kawahata et al. ... 343/700 MS

FOREIGN PATENT DOCUMENTS

JP 124713 4/2000

* cited by examiner

*Primary Examiner*—Tho Phan
(74) *Attorney, Agent, or Firm*—Ostrolenk, Faber, Gerb & Soffen, LLP

(57) ABSTRACT

A patch type radiation electrode is formed in the central area of the upper face of a dielectric substrate. First and second microstrip type radiation electrodes are formed on respective right and left sides of the patch type radiation electrode so as to sandwich the patch type radiation electrode. The first and second microstrip type radiation electrodes are symmetrical with respect to the patch type radiation electrode. If a microstrip type radiation electrode is formed on either one of the right and left sides of the patch type radiation electrode, the directivity of radio waves of the patch type radiation electrode become unsymmetrical, due to effects of the microstrip type radiation electrode. On the other hand, the directivity of radio waves of the patch type radiation electrode can be made symmetrical by forming the microstrip type radiation electrodes on both of the right and left sides of the patch type radiation electrode.

36 Claims, 18 Drawing Sheets

ANTENNA DEVICE AND COMMUNICATION APPARATUS

BACKGROUND OF THE INVENTION

1. Field of the Invention

The present invention relates to an antenna device to be contained in a communication apparatus such as a radio or the like, and a communication apparatus containing the antenna 2. Description of the Related Art The inventors have proposed an antenna device as shown in FIG. 23 in Japanese Patent Application No. H10-295350. It should be noted that the proposed example shown in FIG. 23 does not constitute the related art of the present invention.

In an antenna device 1 shown in FIG. 23A, a patch type radiation electrode 3 and a microstrip type radiation electrode 4 are formed on the surface of a dielectric substrate 2. The antenna device can transmit and receive radio waves in different frequency bands as shown in the return loss characteristic diagram of FIG. 23B.

In particular, as shown in FIG. 23A, on the rectangular parallelepiped dielectric substrate 2, the patch type radiation electrode 3 is formed, and also, the microstrip type radiation electrode 4 is formed thereon at a predetermined interval between the electrodes 3 and 4. Moreover, on a side face 2*b* of the dielectric substrate 2, a feeding electrode 5 is formed in the vicinity of the patch type radiation electrode 3, and also, the microstrip radiation electrode 4 is formed so as to elongate from the upper face 2*a*, bend, and elongate toward the feeding electrode 5 along the upper side of the side face 2*b* to form a feeding end 4*a*. The feeding end 4*a* of the microstrip type radiation electrode 4 is positioned at a predetermined interval between the end 4*a* and the feeding electrode 5. Furthermore, in this example, fixing electrodes 6 to fix the antenna device 1 to a mounting substrate are formed at the corners on the under-face side of the side face 2*b* of the dielectric substrate 2.

Furthermore, the feeding electrode 5 is formed so as to elongate from the side face 2*b* and bend onto the under face 2*f*. A ground electrode 7 is formed substantially on the whole of the under face 2*f* of the dielectric substrate 2 excluding the area in which the feeding electrode 5 is formed and at an interval between the electrodes 5 and 7.

Moreover, the microstrip type radiation electrode 4 is formed so as to elongate from the upper face 2*a* toward the under face 2*f* via a side face 2*d*, and is connected to the ground electrode 7 on the under face 2*f*. That is, the top 4*b* of the elongated microstrip type radiation electrode 4 forms a ground short-circuited end which is connected to the ground electrode 7.

The patch type radiation electrode 3 is a ½ patch type, and is not connected to the ground (in other words, the electrode is separated from the ground), and resonates at a resonance frequency f1 as shown in FIG. 23B. Moreover, the microstrip type radiation electrode 4 is a ¼ microstrip type, and resonates at a resonance frequency f2 which is lower than the above-mentioned resonance frequency f1, as shown in FIG. 23B.

The antenna device 1 is mounted onto a mounting substrate contained in a communication apparatus, with the under face 2*f* of the dielectric substrate 2 being used as a mounting surface. On the mounting substrate (not shown), a signal supply 8 is provided. When the antenna device 1 is plane-mounted in a predetermined area on the mounting substrate, the feeding electrode 5 is connected to the signal supply 8.

When a predetermined power (signal) is supplied from the signal supply 8 to the feeding electrode 5, the signal is fed from the feeding electrode 5 to the patch type radiation electrode 3 and the microstrip type radiation electrode 4 through capacitive coupling. Based on the signal, the patch type radiation electrode 3 and the microstrip type radiation electrode 4 resonate. Thus, transmission-reception of a radio wave (signal) is carried out.

The microstrip type radiation electrode 4 is short-circuited to the ground electrode 7. Accordingly, the microstrip type radiation electrode 4 is equivalent to the ground electrode 7 with respect to the patch type radiation electrode 3. In many cases, a radio wave radiated from the patch type radiation electrode 3 is desired to have a symmetrical directivity. The directivity of the patch type radiation electrode 3, however, is unbalanced, since the microstrip type radiation electrode 4 equivalent to the ground is formed in one of the right and left sides (in the right side in the example of FIG. 23A) of the patch type radiation electrode 3, as described above. That is, the directivity of the patch type radiation electrode 3 is unsymmetrical.

In view of the forgoing, the present invention has been devised. It is an object of the present invention to provide an antenna device and an antenna each of which contains both of the patch type radiation electrode and the microstrip type radiation electrode, and the directivity of the patch type radiation electrode exhibits a good symmetry.

To achieve the above object, the present invention, having the following constitution, provides a means for solving the above problems.

An antenna device in accordance with the present invention includes an antenna device comprising a dielectric substrate, a patch type radiation electrode separated from ground and formed on the surface of the dielectric substrate, and first and second microstrip type radiation electrodes formed on both sides of the patch type radiation electrode at predetermined intervals between the first and second microstrip type radiation electrodes and the patch type radiation electrode, and short-circuited to the ground.

According to the present invention, transmission-reception of radio waves in at least two different frequency bands can be performed by means of only one antenna device, since the antenna device contains the patch type radiation electrode and the two microstrip type radiation electrodes. Moreover, since the first and second microstrip type radiation electrodes are formed on both sides of the patch type radiation electrode at predetermined intervals between them, the microstrip type radiation electrodes equivalent to the ground have effects on both sides of the patch type radiation electrode substantially to the same degree. Thus, a good symmetry of the directivity of the patch type radiation electrode can be attained.

Preferably, the first and second microstrip type radiation electrodes are arranged substantially symmetrically with respect to the patch type radiation electrode. In this case, the symmetry of the patch type radiation electrode can be further enhanced.

Also preferably, the first and second microstrip type radiation electrodes have different resonance frequencies. In this case, the frequency band of the first and second microstrip type radiation electrodes can be widened by decreasing the difference between the resonance frequencies of the first and second microstrip type radiation electrodes to produce a double resonance state.

Moreover, by increasing the difference between the resonance frequencies of the microstrip type radiation electrodes, frequency band of the first microstrip type radiation electrode, and a frequency band of the second microstrip type radiation electrode different from that of the first microstrip type radiation electrode are produced, in addition to the frequency band of the patch type radiation electrode. Accordingly, transmission-reception of radio waves in the three different frequency bands can be performed. Thus, a multiple functions can be provided to the antenna device.

SUMMARY OF THE INVENTION

Other features and advantages of the present invention will become apparent from the following description of the invention which refers to the accompanying drawings.

BRIEF DESCRIPTION OF THE DRAWING(S)

FIG. 1, comprising FIGS. 1A and 1B, illustrates a first embodiment of the present invention;

FIG. 2, comprising FIGS. 2A and 2B, illustrates a modified example of the first embodiment;

Figure 5A:
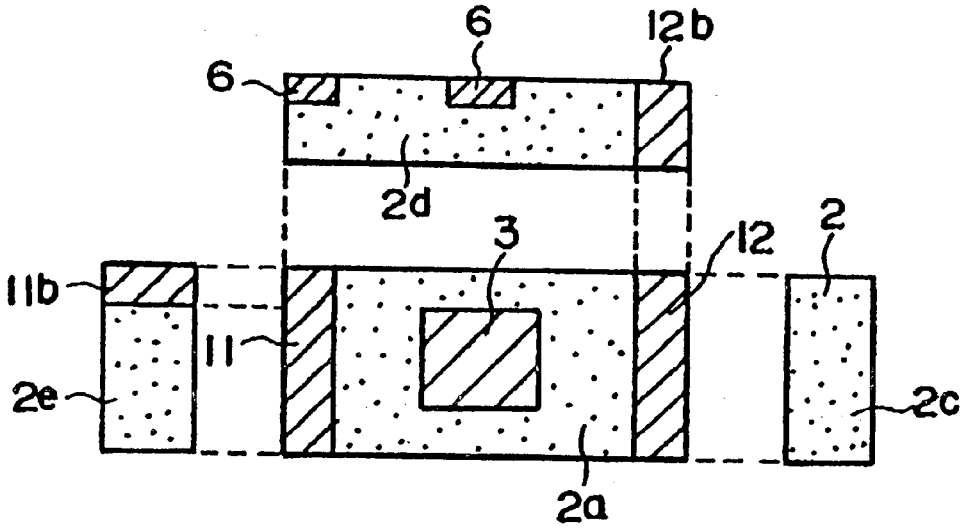
Figure 5B:
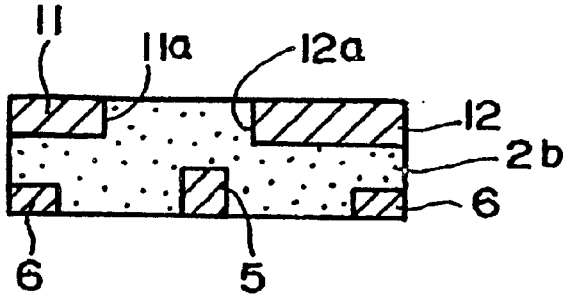
Figure 5C:
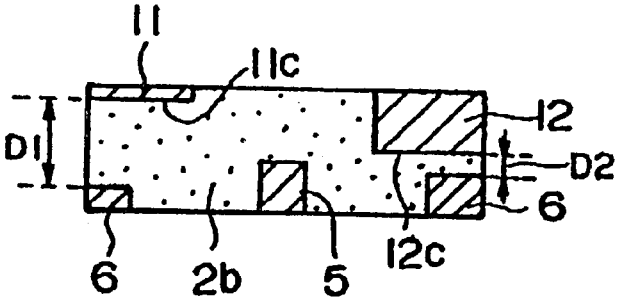
Figure 6A:
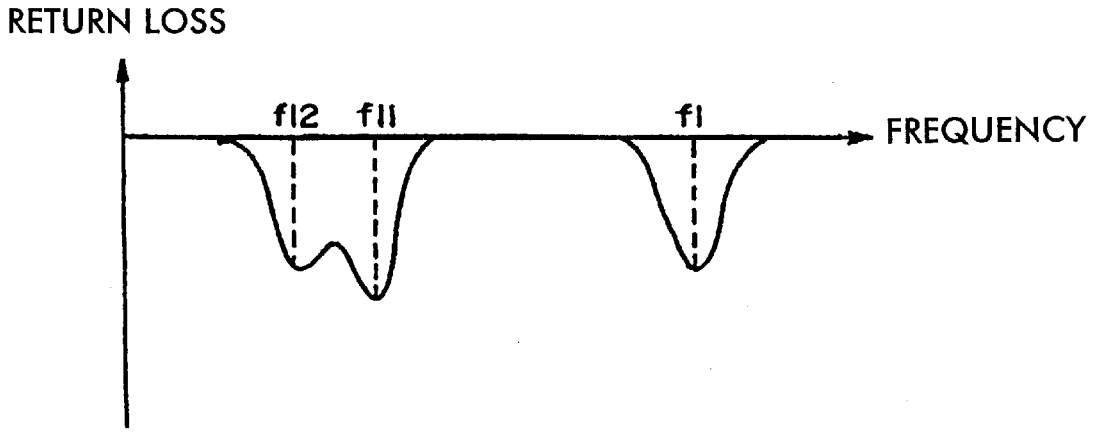
Figure 6B:
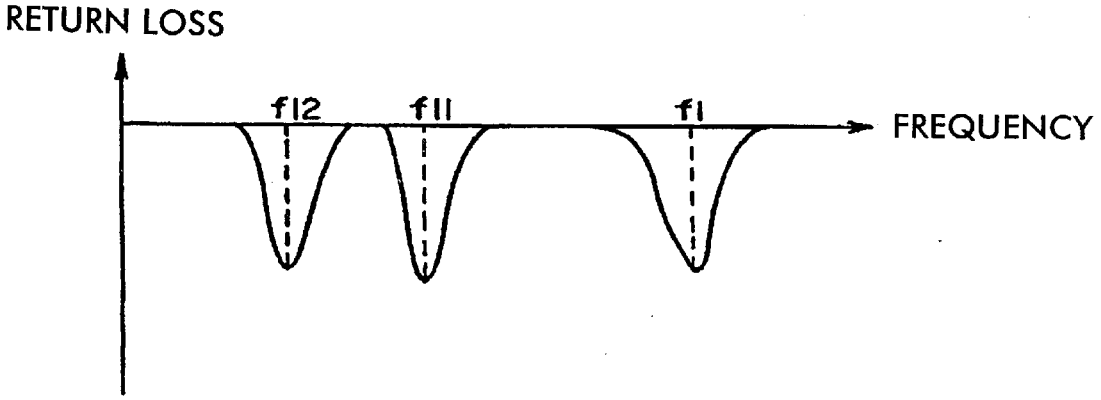
Figure 7:
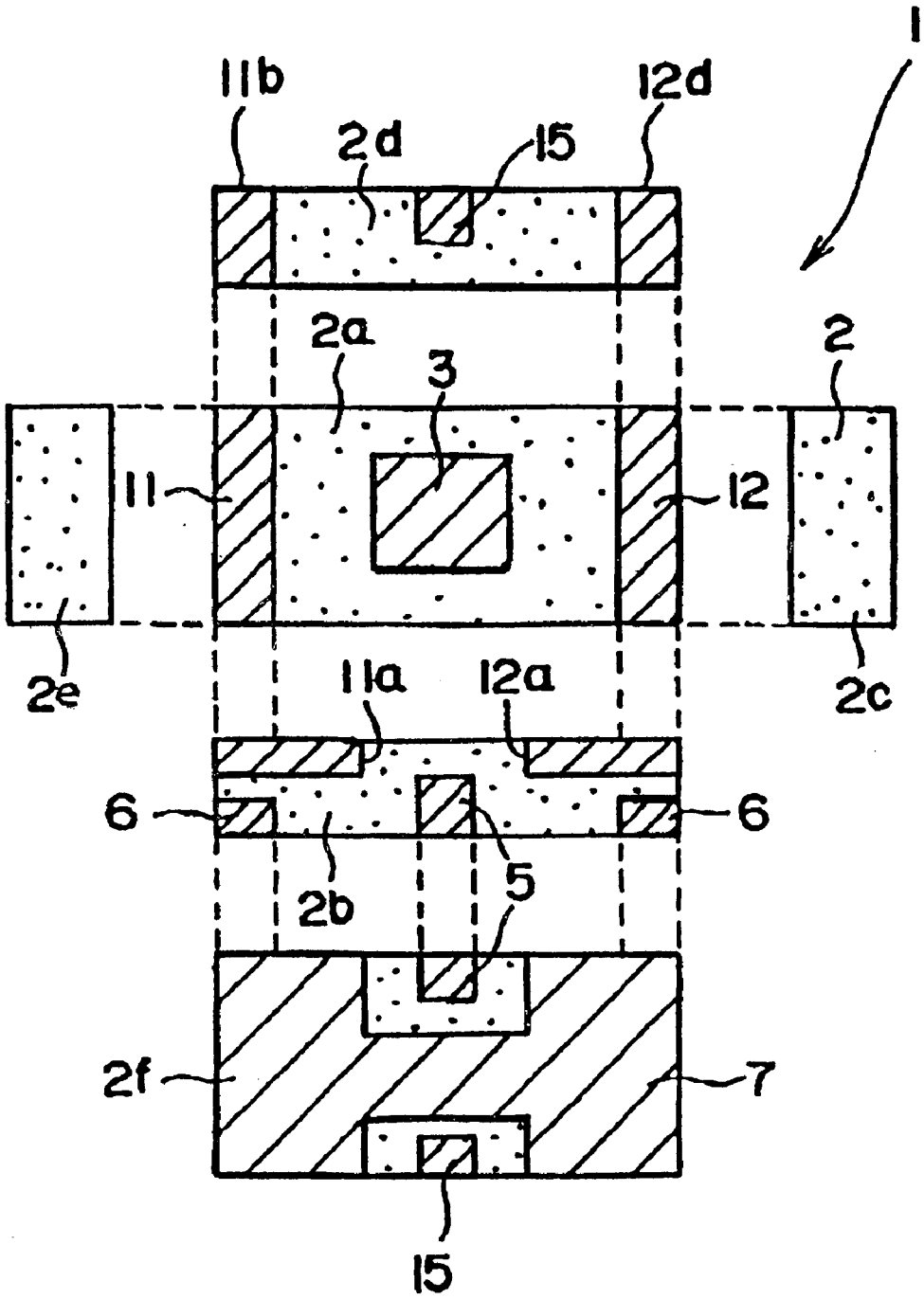
Figure 8A:
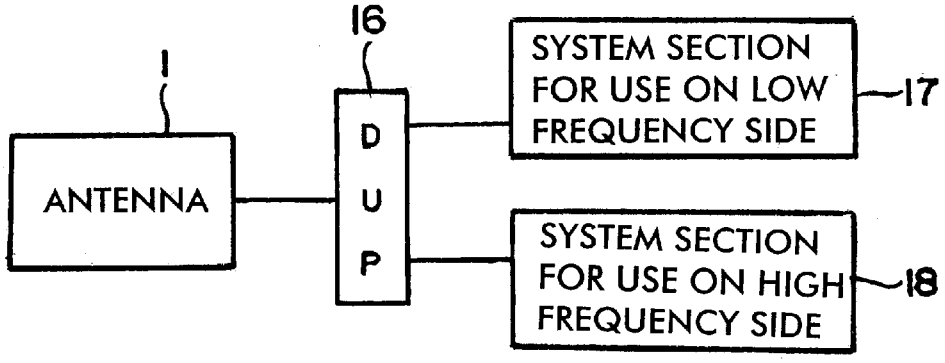
Figure 8B:
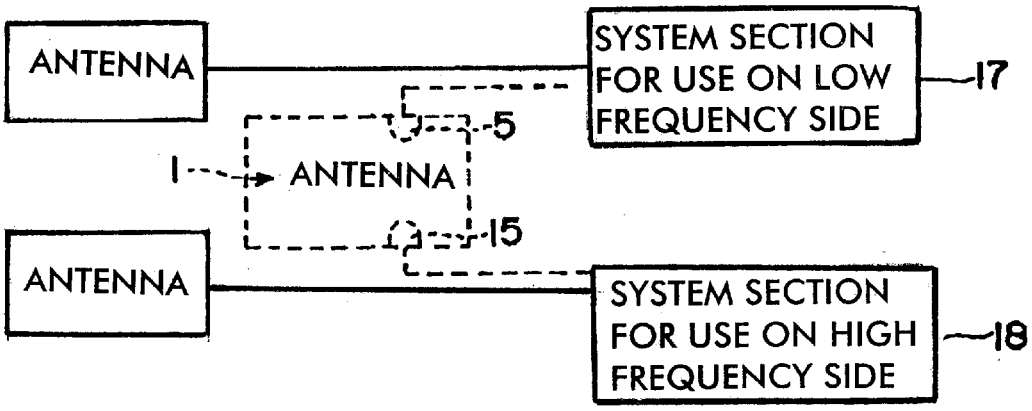
Figure 9A:
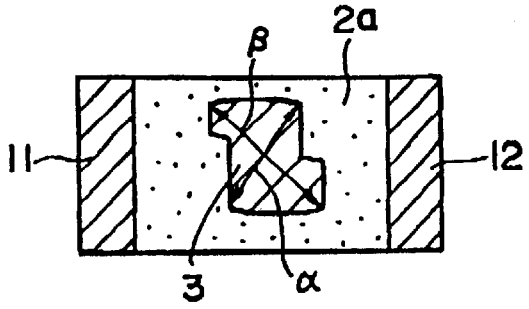
Figure 9B:
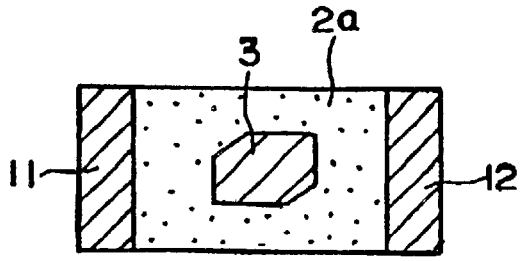
Figure 10:
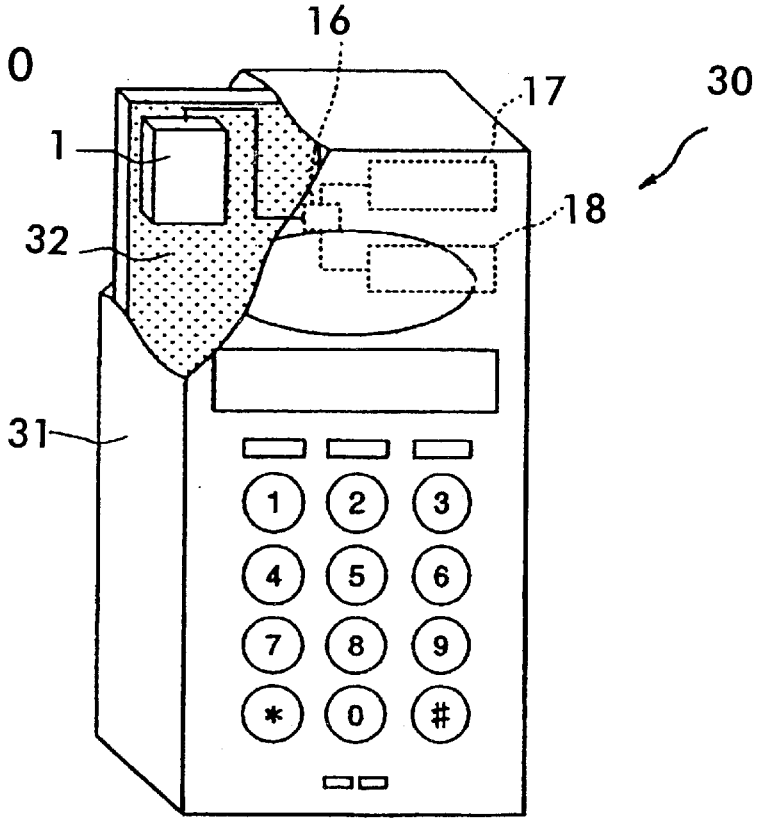
Figure 11:
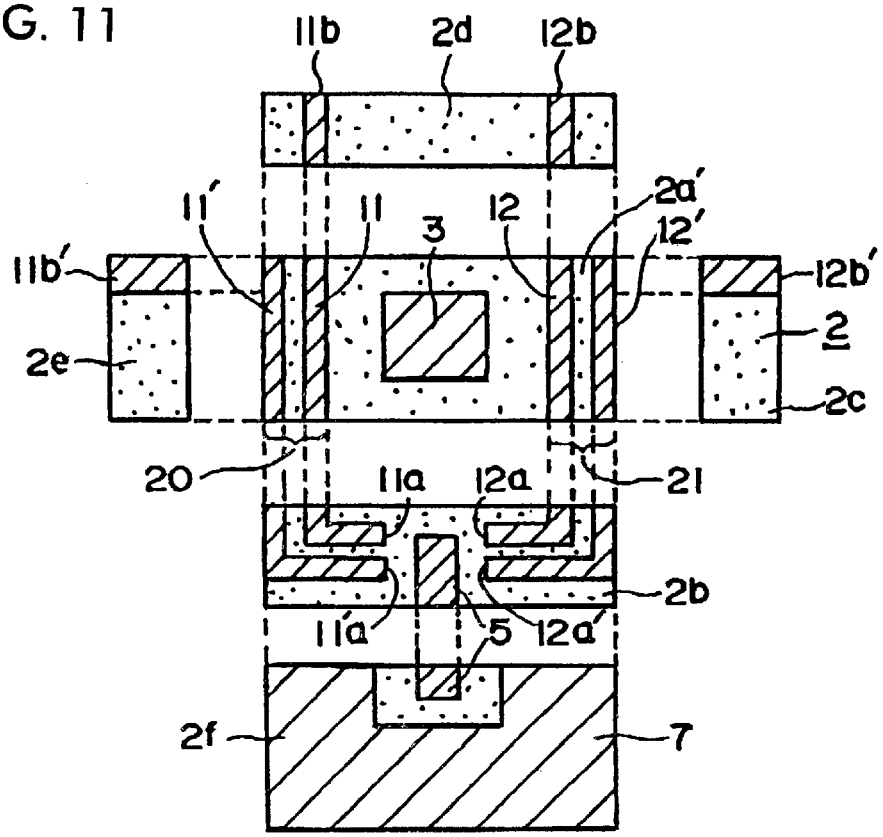
Figure 12:
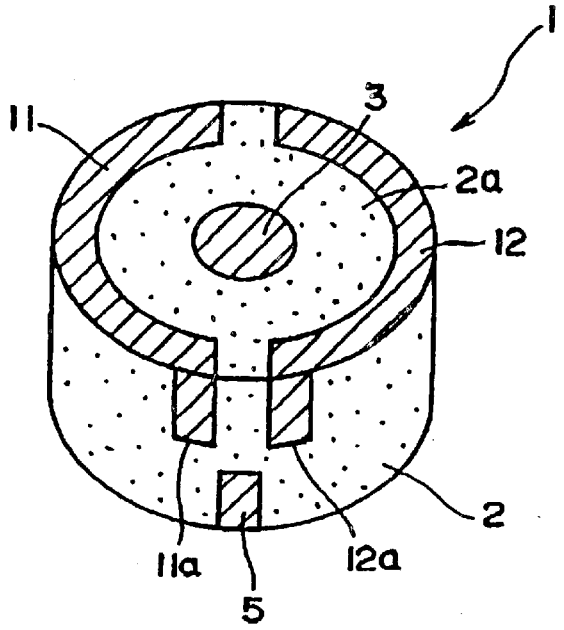
Figure 13A:
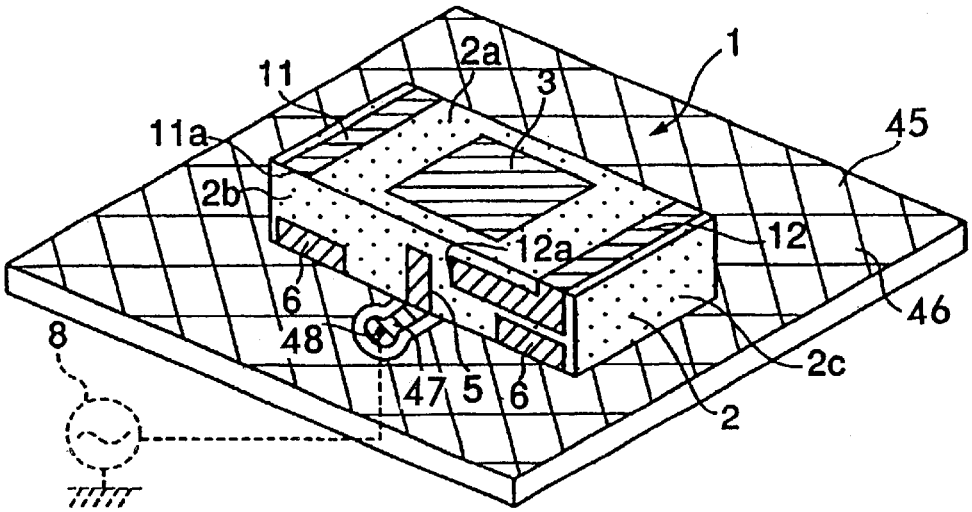
Figure 13B:
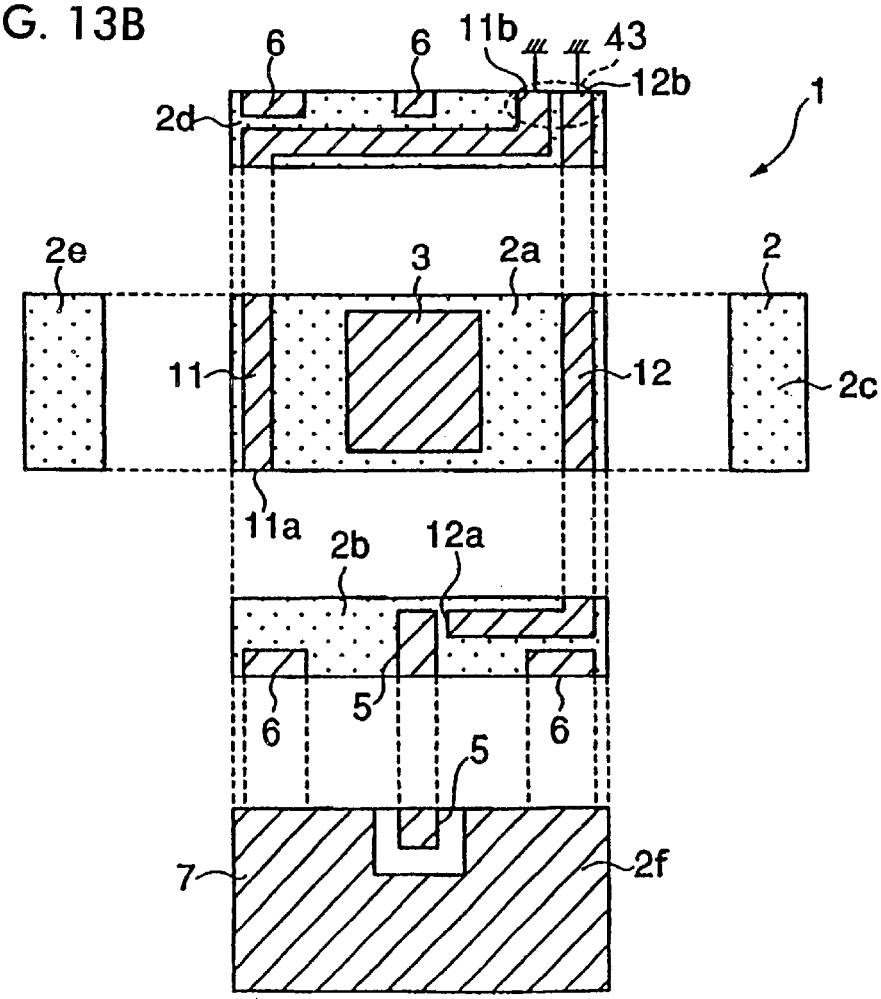
Figure 14A:
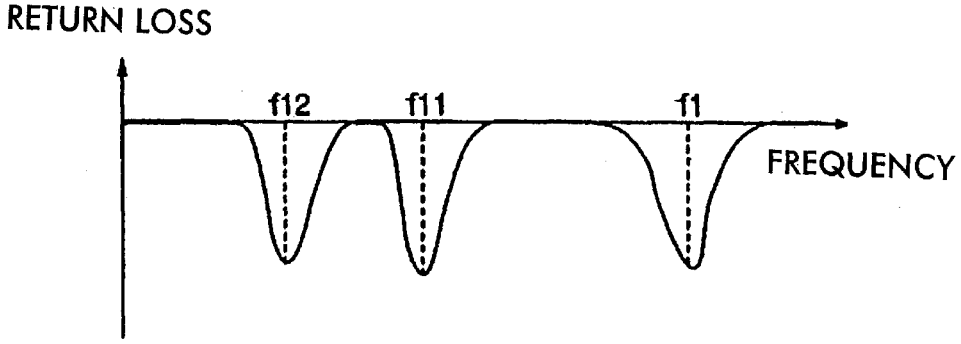
Figure 14B:
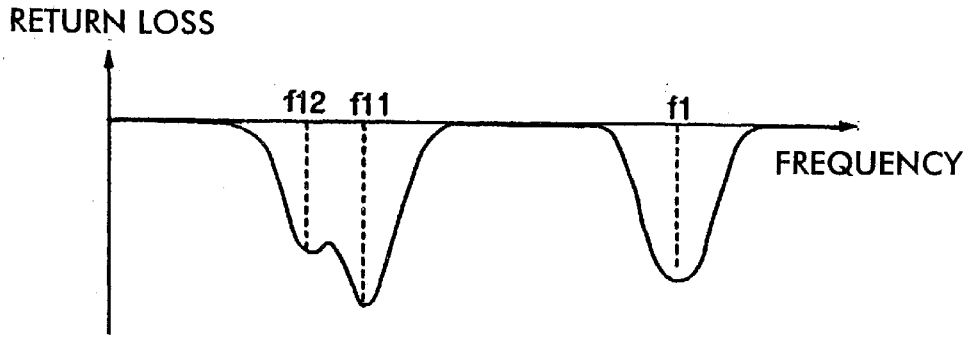
Figure 15:
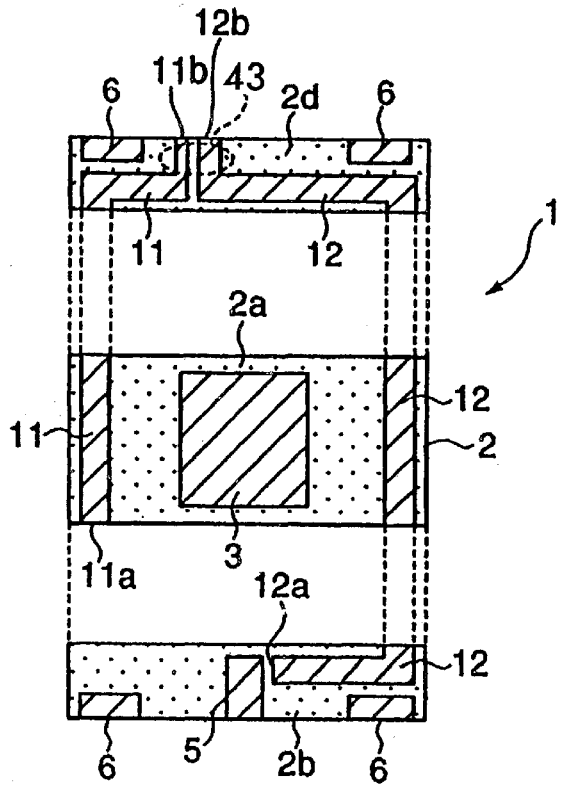
Figure 16A:
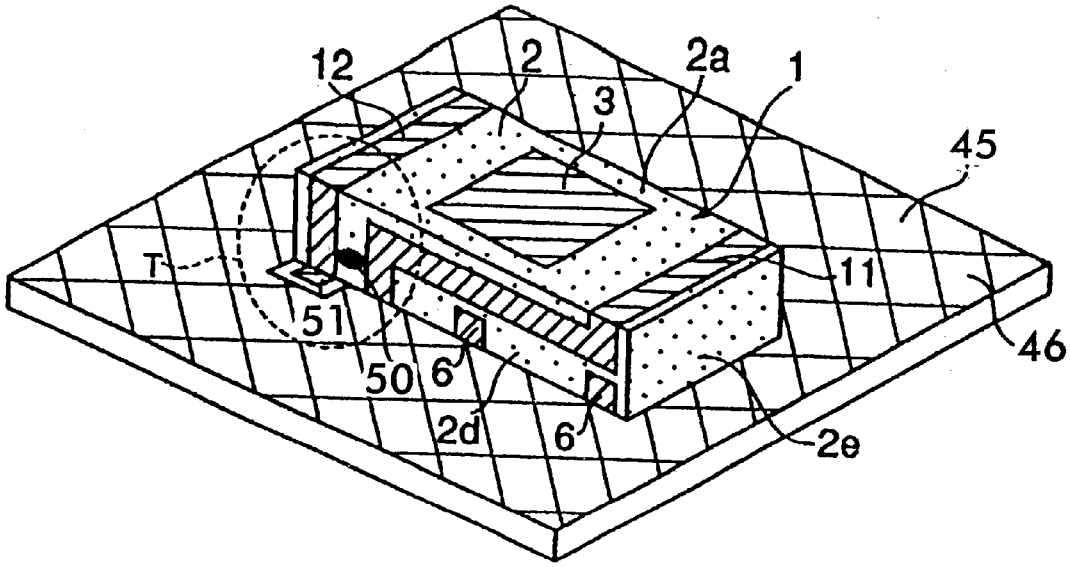
Figure 16B:
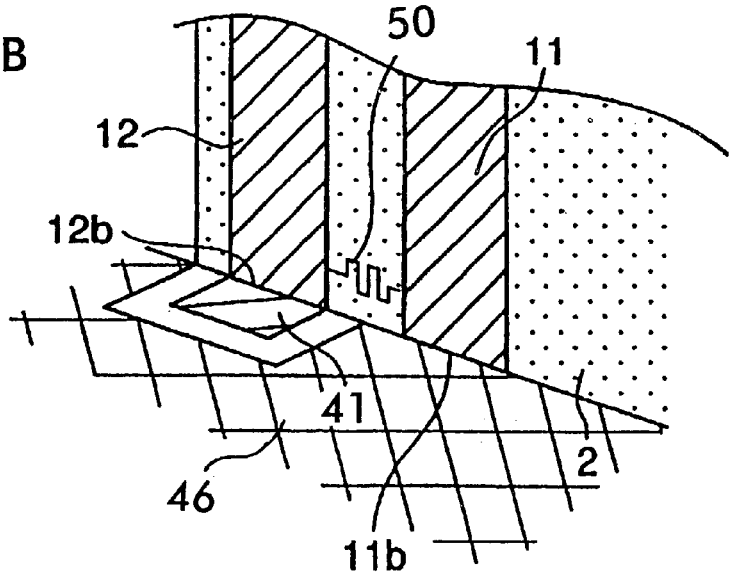
Figure 17:
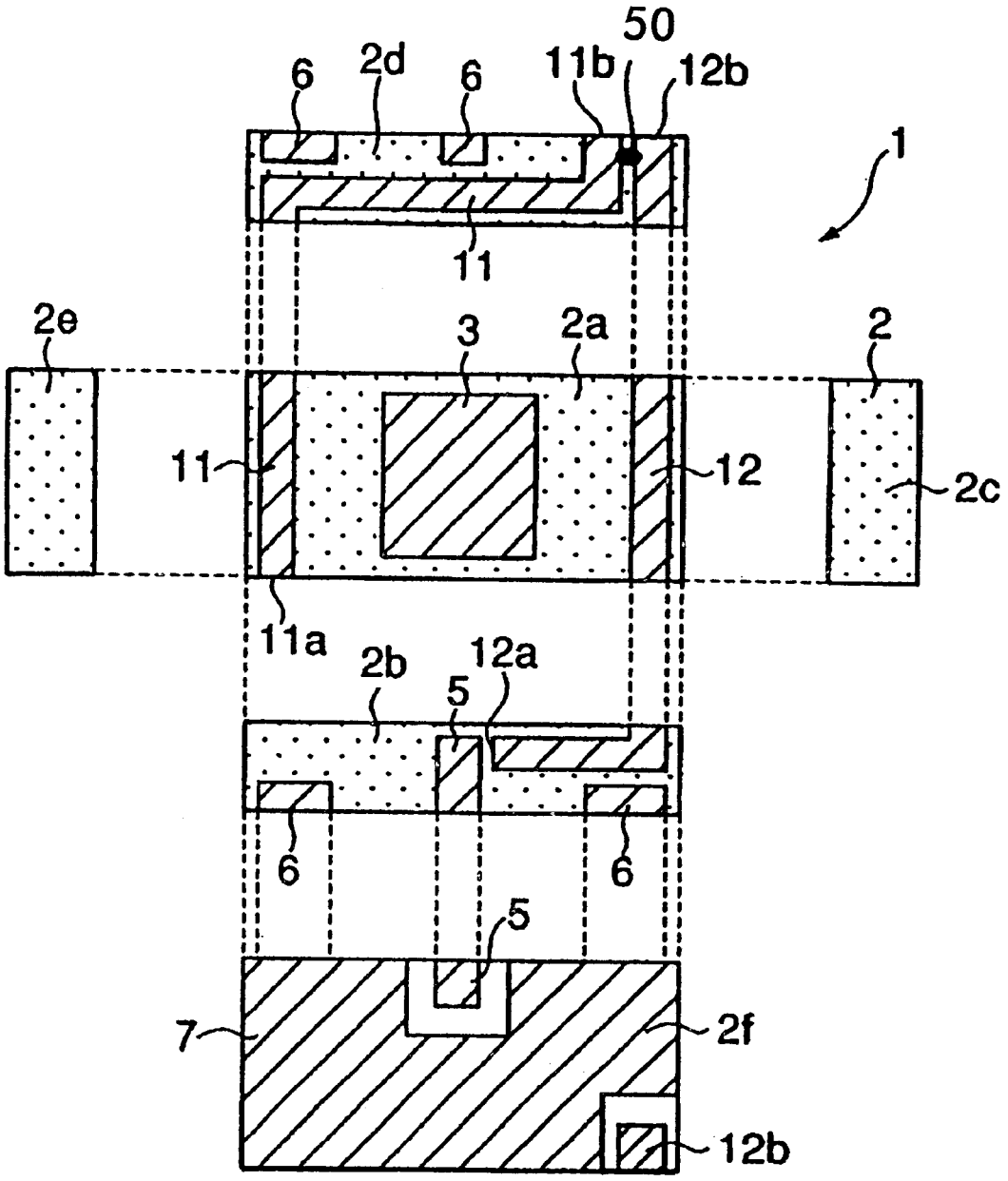
Figure 18A:
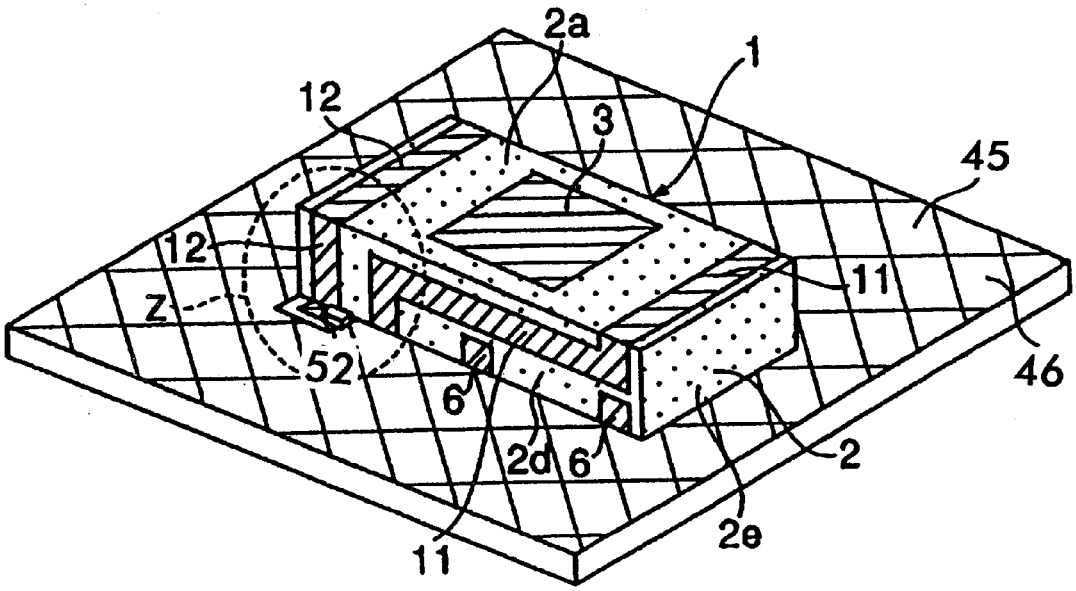
Figure 18B:
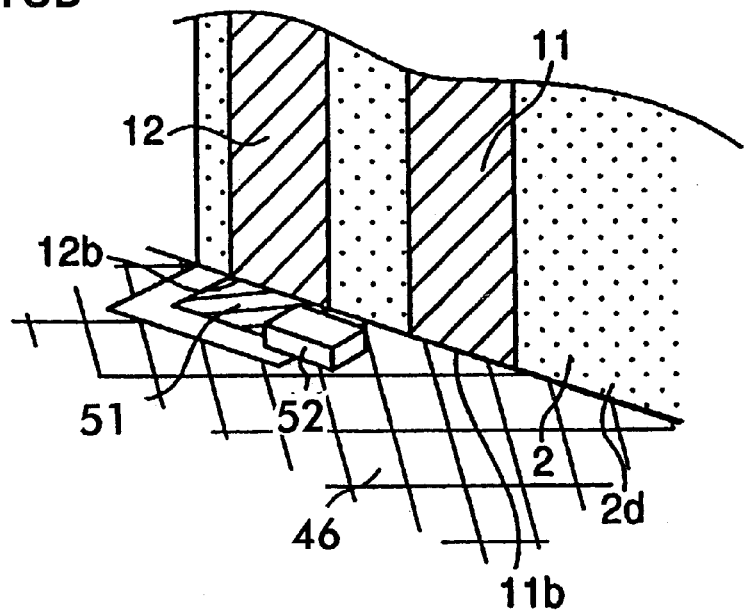
Figure 19A:
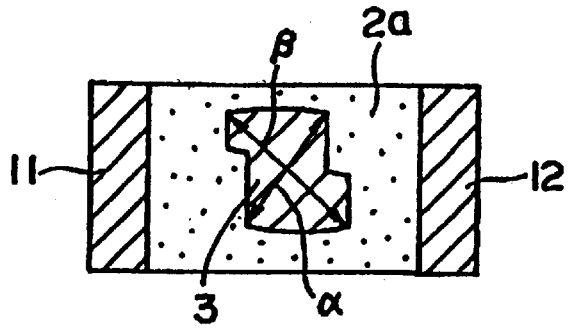
Figure 19B:
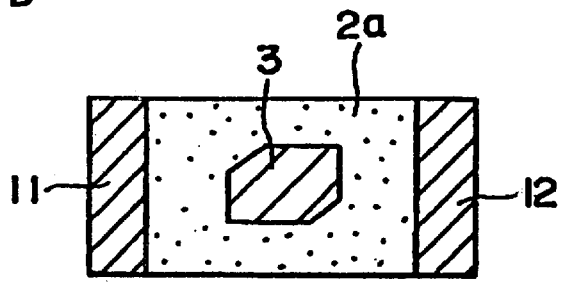
Figure 20:
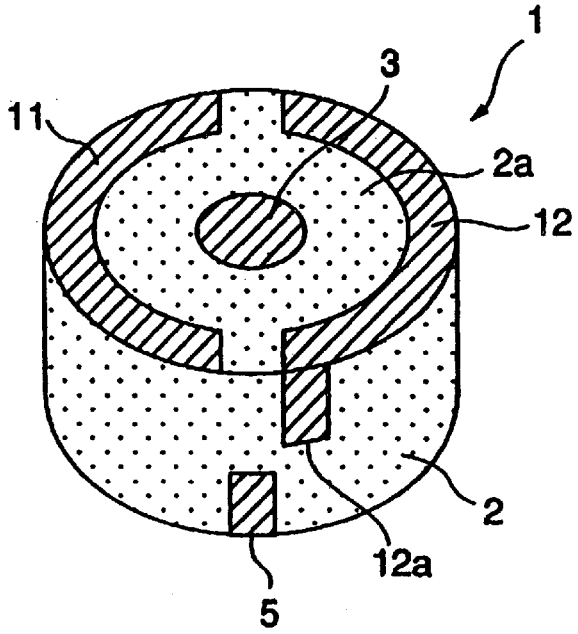
Figure 21A:
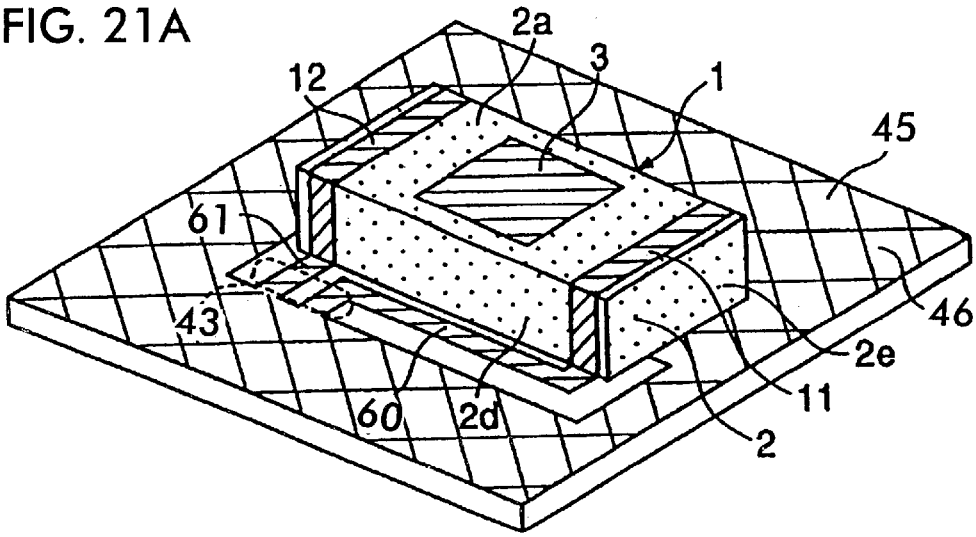
Figure 21B:
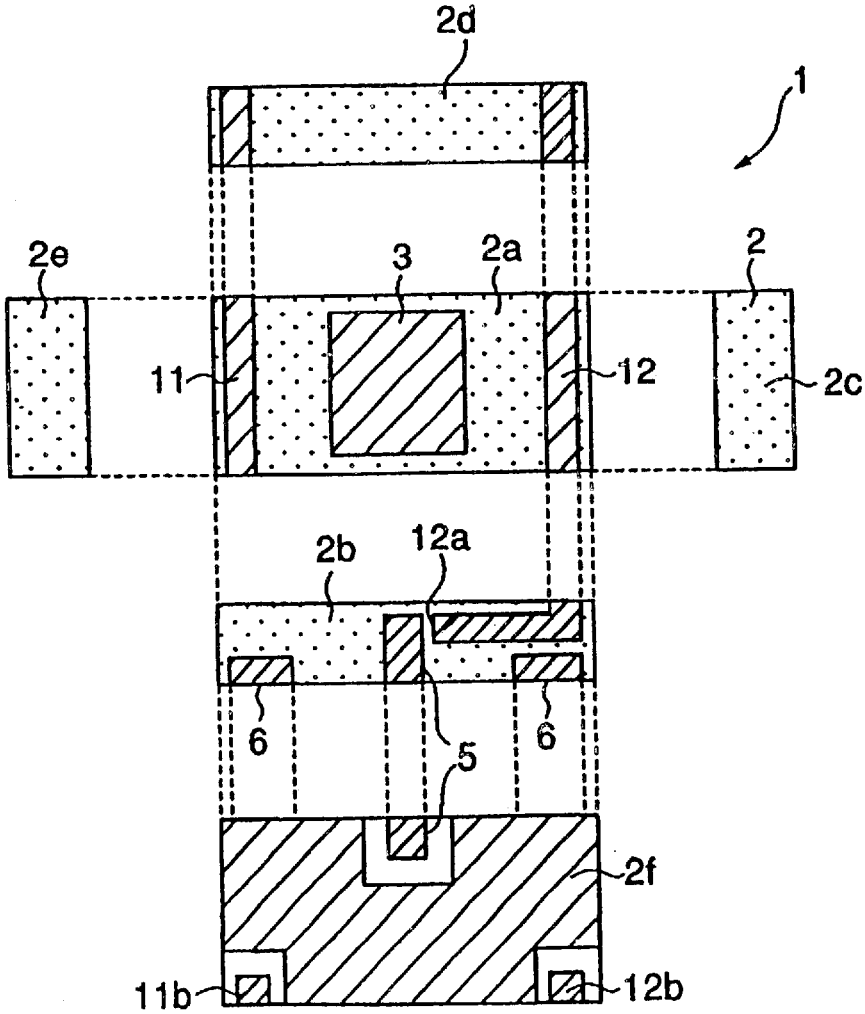
Figure 22:
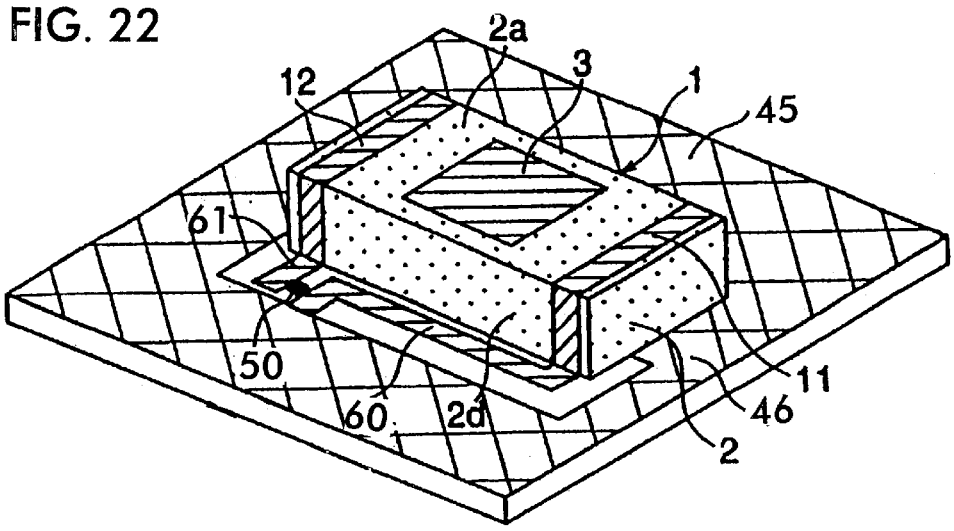
Figure 23A:
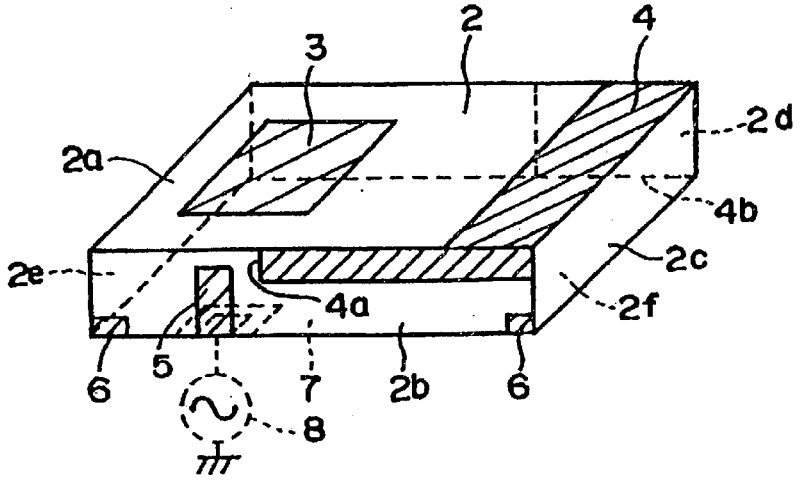
FIG. 23A PRIOR ART
Figure 23B:
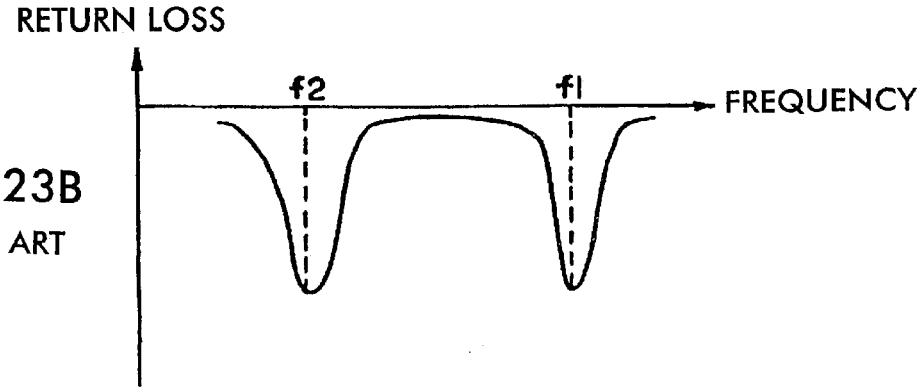
FIG. 23B PRIOR ART

FIG. 5, comprising FIGS. 5A, 5B and 5C, illustrates a modified example of the second embodiment;

FIG. 6, comprising FIGS. 6A and 6B, illustrates an example of the return loss characteristic of the antenna device of the second embodiment;

FIG. 7 illustrates an antenna device according to a third embodiment of the present invention;

FIG. 8, comprising FIGS. 8A and 8B, illustrates a configuration example of a communication apparatus to which the antenna device of the third embodiment of the present invention can be mounted;

FIG. 9, comprising FIGS. 9A and 9B, illustrates an antenna device according to a fourth embodiment of the present invention;

FIG. 10 illustrates a model of a communication apparatus according to a fifth embodiment of the present invention;

FIG. 11 illustrates an antenna device according to a sixth embodiment of the present invention;

FIG. 12 illustrates an antenna device according to a seventh embodiment of the present invention;

FIG. 13, comprising FIGS. 13A and 13B, illustrates an antenna device according to an eighth embodiment of the present invention;

FIG. 14, comprising FIGS. 14A and 14B, is a graph showing an example of the frequency characteristic of the antenna device of the eight embodiment;

FIG. 15 illustrates a modified example of the antenna device of the eighth embodiment;

FIG. 16, comprising FIGS. 16A and 16B, illustrates a model of the mounting structure of an antenna device according to a ninth embodiment and an antenna;

FIG. 17 is a development of an antenna device of the ninth embodiment;

FIG. 18, comprising FIGS. 18A and 18B, illustrates the mounting structure of an antenna device according to a tenth embodiment of the present invention and an antenna;

FIG. 19, comprising FIGS. 19A and 19B, illustrates the patch type radiation electrode of an antenna device according to an eleventh embodiment of the present invention;

FIG. 20 illustrate the dielectric substrate of an antenna device according to a twelfth embodiment of the present invention;

FIG. 21, comprising FIGS. 21A and 21B, illustrates an antenna device according to a thirteenth embodiment of the present invention;

FIG. 22 illustrates a modified example of the antenna device of the thirteenth embodiment; and FIG. 23, comprising FIGS. 23A and 23B, is a schematic view of an antenna device proposed by the present applicant in Japanese Patent Application No. 2000-124731.

DETAILED DESCRIPTION OF EMBODIMENTS OF THE INVENTION

Hereinafter, embodiments of the present invention will be described in detail.

(First Embodiment)

Figure 1A:
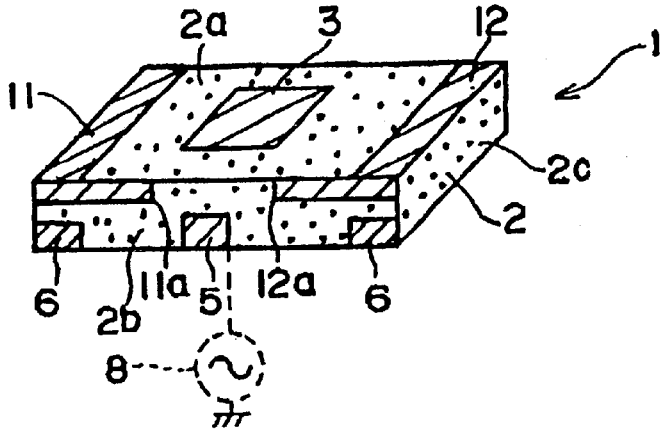
Figure 1B:
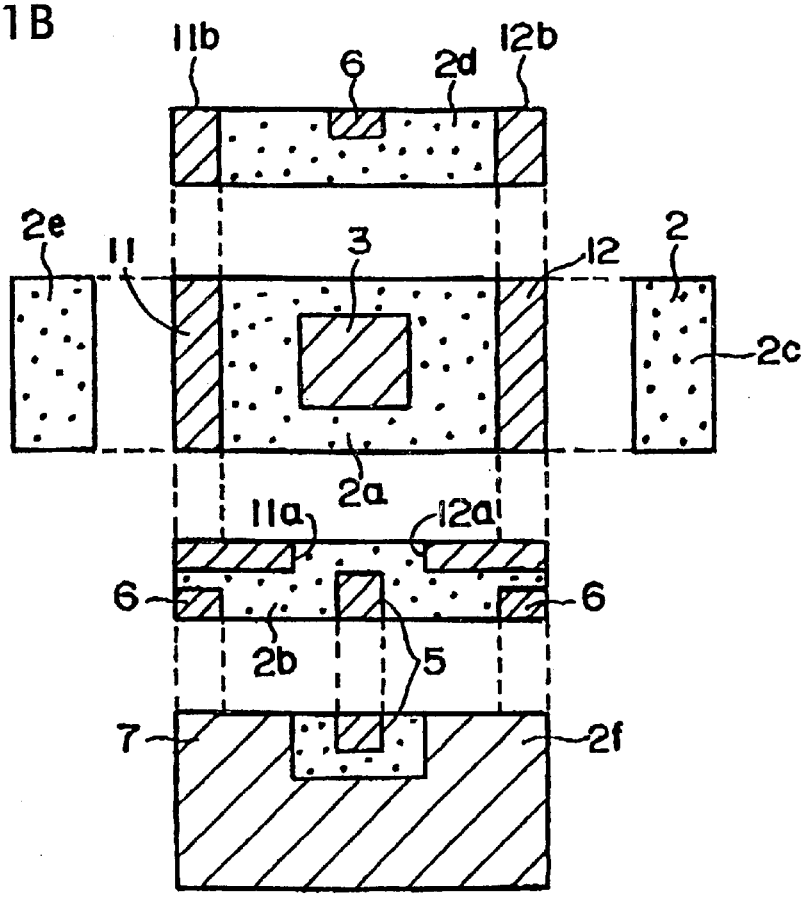

FIG. 1A is a perspective view of an antenna device according to a first embodiment of the present invention. FIG. 1B shows the antenna device of FIG. 1A in a developed state. In the description of the first embodiment, similar parts in the first embodiment and the above-described proposed example are designated by the same reference numerals, and the repeated description is omitted.

In the first embodiment, characteristically, a first microstrip type radiation electrode 11 and a second microstrip type radiation electrode 12 are formed respectively on of the left and right sides of the patch type radiation electrode at a predetermined interval from the patch type radiation electrode 3, as shown in FIGS. 1A and 1B.

As shown in FIGS. 1A and 1B, the patch type radiation electrode 3 is formed substantially in the center of the upper face 2*a* of the dielectric substrate 2. In this embodiment, the first microstrip type radiation electrode 11 is disposed on the left side of the patch type radiation electrode 3 at a predetermined interval between them, while the second microstrip type radiation electrode 12 is disposed on the right side of the patch type radiation electrode 3 at a predetermined interval between them, as viewed in FIGS. 1A and 1B. The first and second microstrip type radiation electrodes 11 and 12 are formed substantially symmetrically with respect to the patch type radiation electrode 3.

One end-sides of the microstrip type radiation electrodes 11 and 12 are formed so as to elongate from the upper face 2*a* onto the side face (front side face) 2*b*, and then, bend and elongate along the upper side of the side face 2*b* toward the center, whereby elongated ends 11*a* and 12*a* are formed, respectively. The respective elongated ends 11*a* and 12*a* are arranged so as to have predetermined intervals between the ends 11*a* and 11*b* and the feeding electrode 5, and constitute feeding ends to which a signal from the feeding electrode 5 is fed through capacitive coupling.

The other end-sides of the microstrip type radiation electrodes 11 and 12 are formed so as to elongate from the upper face 2*a* toward the under face 2*f* via the side face (back side face) 2*d* and connected to the ground electrode 7 on the under face 2*f*. That is, the ends 11*b* and 12*b* of the microstrip type radiation electrodes 11 and 12 constitute the ground short-circuited ends, respectively.

In the first embodiment, the microstrip type radiation electrodes 11 and 12 have the same resonance frequency. Regarding the resonance frequency, the microstrip type radiation electrodes 11 and 12 resonate at the resonance frequency f2 which is different from the resonance frequency f1 of the patch type radiation electrode 3. That is, the antenna device 1 of this embodiment can transmit and receive radio waves in two different frequency bands as well as the above-described proposed example.

Furthermore, in this embodiment, the first and second microstrip type radiation electrodes 11 and 12 are formed on both sides of the patch type radiation electrode 3 so as to sandwich the patch type radiation electrode 3. Accordingly, the problem of the proposed example, that is, the problem that the directivity of the patch type radiation electrode 3 is unsymmetrical, due to the fact that the microstrip type radiation electrode equivalent to the ground is formed only on either one of the right or left side of the patch type radiation electrode 3 can be substantially avoided.

Especially, since the first and second microstrip type radiation electrodes 11 and 12 are formed substantially symmetrically with respect to the patch type radiation electrode 3, the electromagnetic influences of the respective microstrip type radiation electrodes 11 and 12 over the directivity of the patch type radiation electrode 3 are substantially equal to each other on the right and left sides of the patch type radiation electrode 3. Thus, the directivity of the patch type radiation electrode 3 can be made symmetrical.

In the example of FIG. 1, the ground short-circuited ends 11*b* and 12*b* of the microstrip type radiation electrodes are connected to the ground electrode 7, individually. For example, as shown in the modified example of FIG. 2A, an electrode 13 may be formed on the whole of the side face (back side face) 2*d*. Both of the ground short-circuited ends 11*b* and 12*b* are connected to the electrode 13. Thus, the microstrip type radiation electrodes 11 and 12 may be short-circuited to the ground electrode 7 via the electrode 13.

Figure 2A:
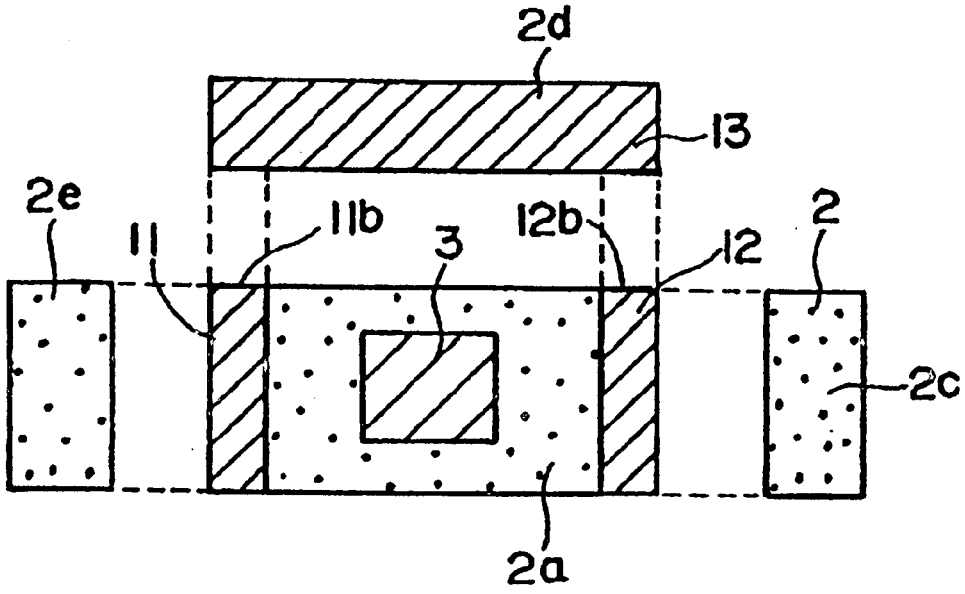
Figure 2B:
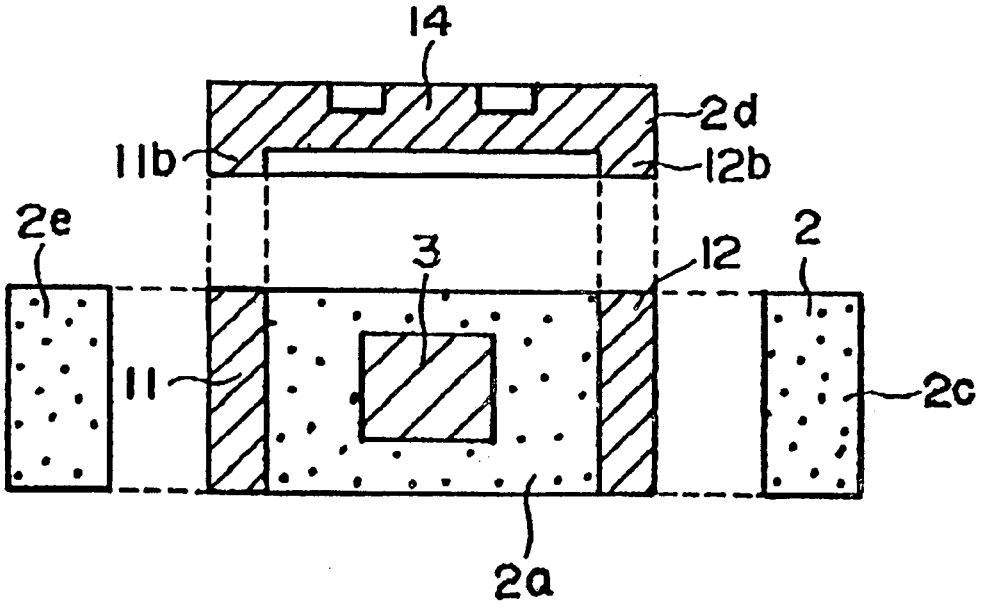

Furthermore, as shown in the modified example of FIG. 2B, an E-character shaped electrode 14 is formed on the side face 2*d*. Both of the ground short-circuited ends 11*b* and 12*b* are connected to the electrode 14. Thus, the microstrip type radiation electrodes 11 and 12 may be short-circuited to the ground electrode 7 via the electrode 14.

In the example of FIG. 1, the microstrip type radiation electrodes 11 and 12 are connected to the ground electrode 7 via the side face 2*d*, respectively. However, as shown in the modified example of FIG. 3, the first microstrip type radiation electrode 11 may be formed so as to elongate from the upper face 2*a* to the under face 2*f* via the left side-face 2*e* to be connected to the ground electrode 7. Moreover, the second microstrip type radiation electrode 12 may be formed so as to elongate from the upper face 2*a* to the under face 2*f* via the side-face (right side-face) 2*c* to be connected to the ground electrode 7.

Figure 3:
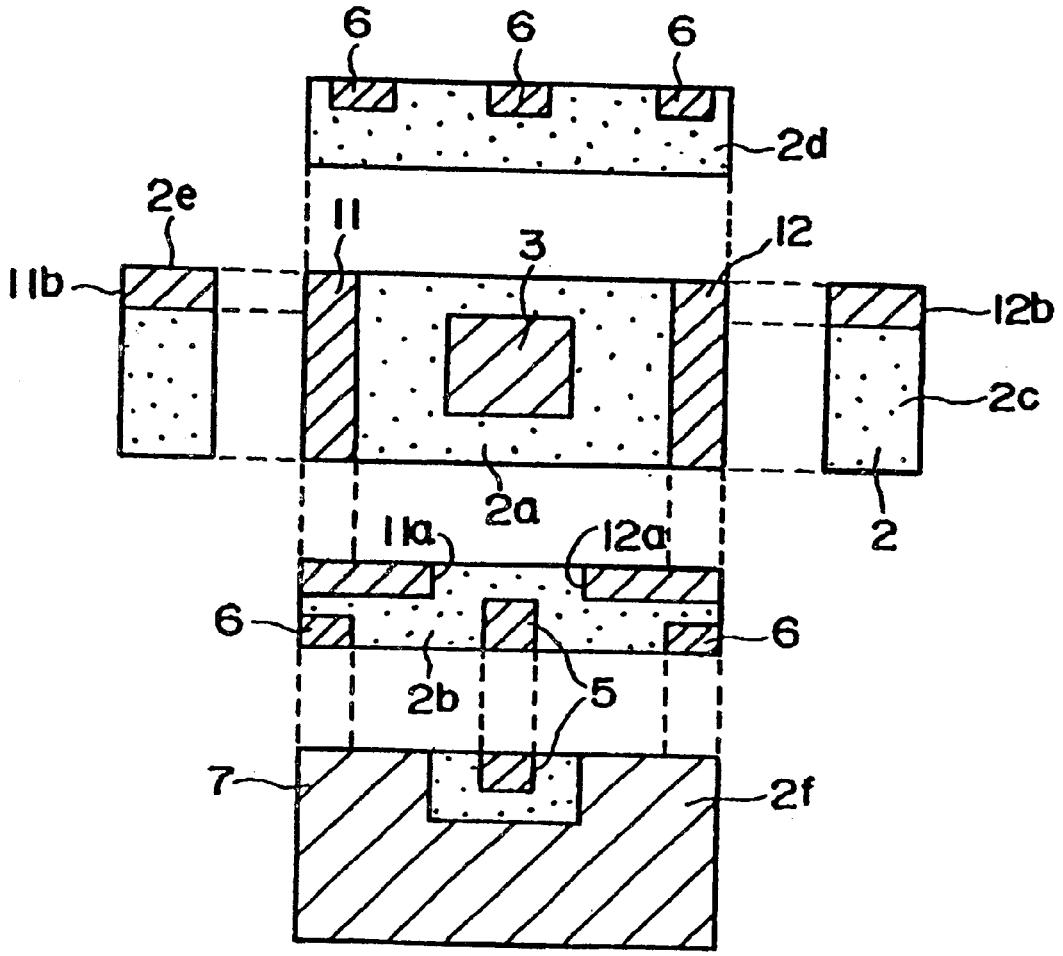
FIG. 3 illustrates another modified example of the first embodiment.

In the modified examples of the antenna device shown in FIGS. 2A, 2B, and 3, the first and second microstrip type radiation electrodes 11 and 12 are formed on the left and right sides of the patch type radiation electrode 3, respectively, similarly to the antenna device of FIG. 1. This improves the symmetry of the directivity of the patch type radiation electrode 3.

The feeding electrode 5 may be formed so as to elongate onto the upper face 2*a* of the dielectric substrate 2 in order to enhance the coupling capacity for the respective radiation electrodes.

(Second Embodiment)

Hereinafter, a second embodiment will be described. In the description of the second embodiment, similar parts in the first and second embodiments are designated by the same reference numerals, and the repeated description of the parts is omitted.

In the second embodiment, characteristically, the first and second microstrip type radiation electrodes 11 and 12 have different resonance frequencies. The other constitutions are substantially the same as those of the first embodiment.

In a microstrip type radiation electrode, for example, in the first microstrip type radiation electrode 11 (or the second microstrip type radiation electrode 12), the inductance component and the resonance frequency are varied, depending on the length and the diameter of the current path from the feeding end 11*a* (12*a*) to the ground short-circuited end 11*b* (12*b*). More concretely, the inductance component of the microstrip type radiation electrode is varied in the increasing direction with the current path length being longer and the current path diameter being smaller, and therefore, the resonance frequency is varied in the decreasing direction.

Figure 4:
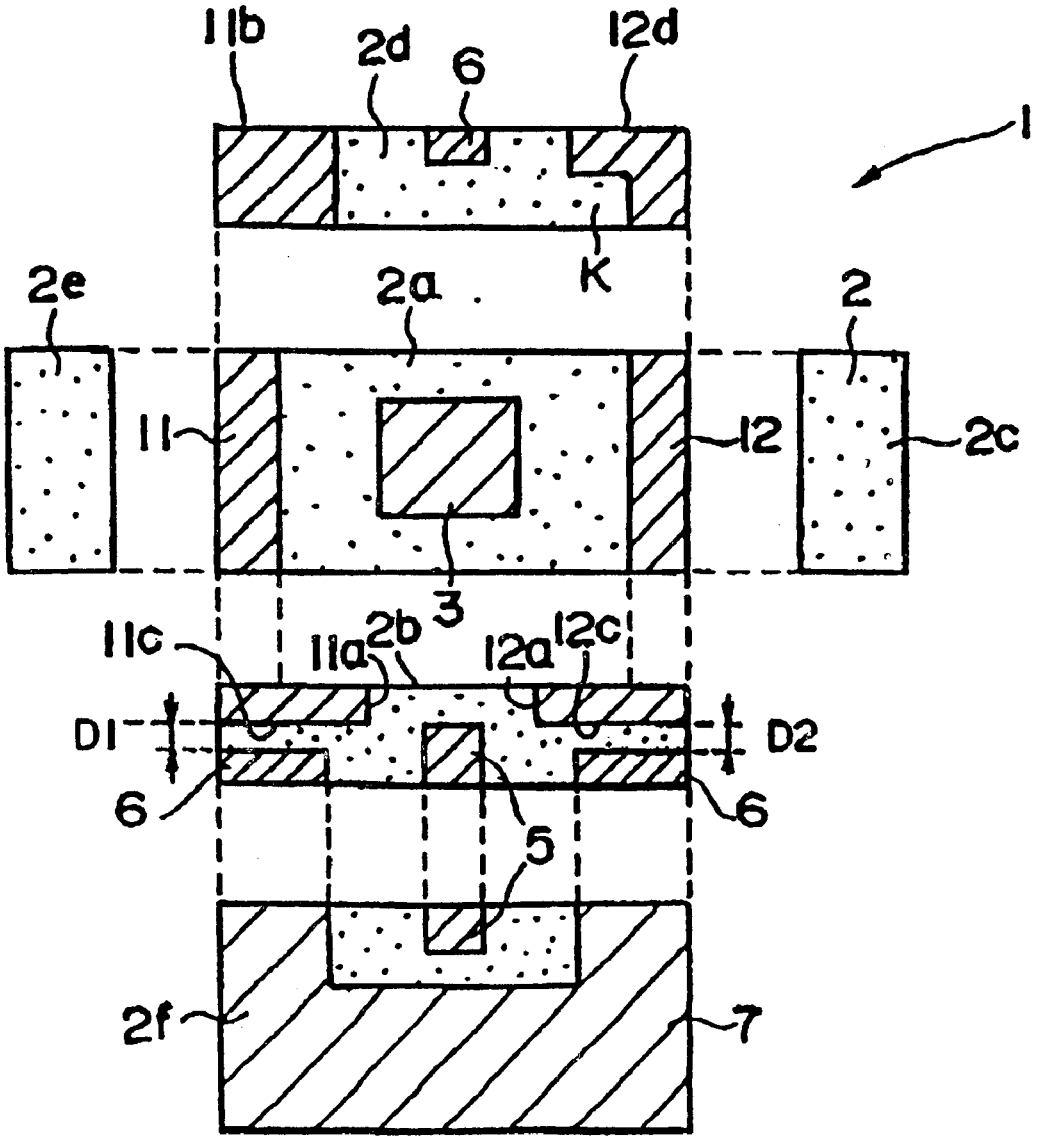
FIG. 4 illustrates an antenna device according to a second embodiment of the present invention.

The electrostatic capacity between an open end and the ground is varied, depending on the distance between the open end (in the example of FIG. 4, an open end 11*c* of the first microstrip type radiation electrode 11 or an open end 12*c* of the second microstrip type radiation electrode 12) and the ground (in the example of FIG. 4, the fixed electrode 6). Thus, the resonance frequency of the patch type radiation electrode is varied. More specifically, the resonance frequency of the microstrip type radiation electrodes is varied in the increasing direction with the electrostatic capacitance between the open end and the ground being decreased.

In the second embodiment, the resonance frequency f1 of the first microstrip type radiation electrode 11 is different from the resonance frequency f2 of the second microstrip type radiation electrode 12. In particular, the example of FIG. 4 has a similar configuration to that of FIG. 1, but the electrode area on the side face 2*d* in the second microstrip type radiation electrode 12 is smaller than that the side face 2*d* of the first microstrip type radiation electrode 11 on the side face 2*d* by the amount corresponding to a formed deficiency k (that is, the current path becomes thin). For this reason, the inductance component of the second microstrip type radiation electrode 12 is larger than that of the first microstrip type radiation electrode 11, and the resonance frequency f12 of the second microstrip type radiation electrode 12 is lower than that f11 of the first microstrip type radiation electrode 11. In other words, the resonance frequency f11 of the first microstrip type radiation electrode 11 is higher than that f12 of the second microstrip type radiation electrode 12.

Moreover, in the modified example of FIG. 5A, the first microstrip type radiation electrode 11 is connected to the ground electrode 7 via the side face 2*e*. The second microstrip type radiation electrode 12 is connected to the ground electrode 7 via the side face 2*d*. The other configurations are similar to those of FIG. 1. That is, the inductance components of the first and second microstrip type radiation electrodes 11 and 12 can be controlled by use of the difference between the positions at which the ground short-circuited ends 11*b* and 12*b* are formed. Thus, the resonance frequencies f11 and f12 of the first and second microstrip type radiation electrodes 11 and 12 can be set at different values, if necessary.

Moreover, the modified example of FIG. 5B has a similar configuration to that of FIG. 1, except that the feeding end 11*a* of the first microstrip type radiation electrode 11 is formed so as to be more distant from the feeding electrode 5 than the feeding end 12*a* of the second microstrip type radiation electrode 12. Therefore, the current path length of the first microstrip type radiation electrode 11 is shorter than that of the second microstrip type radiation electrode 12, so that the inductance component of the first microstrip type radiation electrode 11 is smaller than that of the second microstrip type radiation electrode 12. Therefore, similarly, the resonance frequency f11 of the first microstrip type radiation electrode 11 is higher than that f12 of the second microstrip type radiation electrode 12.

Furthermore, the modified example of FIG. 5C has a configuration similar to that of FIG. 1. Characteristically, an interval D1 between the open end 12*c* of the first microstrip type radiation electrode 11 and the fixed electrode 6 is larger than that D2 between the open end 12*c* of the second microstrip type radiation electrode 12 and the fixed electrode 6. As a result, the capacitance between the open end 11*c* of the first microstrip type radiation electrode 11 and the fixed electrode 6 (ground) is smaller than that between the open end 12*c* of the second microstrip type radiation electrode 12 and the fixed electrode 6 (ground). Similarly, the resonance frequency f11 of the first microstrip type radiation electrode 11 is higher than that f12 of the second microstrip type radiation electrode 12.

As described above, in the second embodiment, the resonance frequencies f11 and f12 of the first and second microstrip type radiation electrodes 11 and 12 are different from each other. The antenna device 1 has the return loss characteristic shown in FIG. 6A, or alternatively, that shown in FIG. 6B, by appropriately setting the difference Df between the resonance frequencies f11 and f12 of the microstrip type radiation electrodes 11 and 12 by utilization of the inductance components of the microstrip type radiation electrodes 11 and 12, and the electrostatic capacitances between the open ends and ground.

In particular, the frequency band on the lower frequency side gets into a double-resonance state as shown in FIG. 6A, by decreasing the difference Df between the resonance frequencies f11 and f12. Thus, the frequency band can be widened.

Furthermore, if the difference Df between the resonance frequencies f11 and f12 is increased, three frequency bands are formed as shown in FIG. 6B. That is, multi-functions can be rendered.

In the second embodiment, similarly to the above-described first embodiment, the first and second microstrip type radiation electrodes 11 and 12 are formed substantially symmetrically with respect to the patch type radiation electrode 3 on the upper face 2*a* of the dielectric substrate 2. Accordingly, a symmetrical directivity can be rendered to the patch type radiation electrode 3. In addition, the resonance frequencies f11 and f12 of the first and second microstrip type radiation electrodes 11 and 12 are different from each other. Thus, by setting the difference Df between the resonance frequencies f11 and f12, the frequency band can be widened, attributed to the formation of a double-resonance state, or a multi-frequency band can be realized, which involves at least three radio wave transmission-reception frequency bands. Thus, the frequency band can be easily developed correspondingly to uses of the antenna device 1.

Moreover, the inductance components of the microstrip type radiation electrodes 11 and 12 can be controlled by producing a desired capacitance between the ground short-circuited ends 11*a* and 12*a* and the fixed electrodes 6. That is, the respective resonance frequencies of the first and second microstrip type radiation electrodes 11 and 12 can be controlled by adjusting the gaps between the ground short-circuited ends 11*a* and 12*a* and the fixed electrodes 6, respectively.

(Third Embodiment)

Hereinafter, a third embodiment will be described. In the description of the third embodiment, similar parts in this embodiment and the above-described embodiments are designated by the same reference numerals, and the repeated description of the parts is omitted.

In this embodiment, characteristically, a second feeding electrode 15 is provided in addition to the configuration of each of the above-described embodiments, as shown in FIG. 7. The second feeding electrode 15 is formed on the side face 2*d* of the dielectric substrate 2 and in the vicinity of the patch type radiation electrode 3. The second feeding electrode 15 is formed so as to elongate on the side face 2*d*, bend, and elongate on the under face 2*f*. The second feeding electrode 15 is not short-circuited to the ground electrode 7. When a signal is externally supplied to the second feeding electrode 15, the electrode 15 feeds the signal to the patch type radiation electrode 3 through the capacitive coupling.

Meanwhile, as a communication apparatus which can transmit and receive radio waves in two different frequency bands, apparatus having the configurations shown in FIG. 8A and FIG. 8B are exemplified.

In particular, the communication apparatus having the configuration shown in FIG. 8A comprises DUP (duplexer (radio wave separation section)) 16, a system section 17 for use on the low frequency side, and a system section 18 for use on the high frequency side. For example, when the antenna device 1 shown in FIG. 1 is mounted, the feeding electrode 5 of the antenna device 1 is connected to the system section 17 for use on the low frequency side and the system section for use on the high frequency side. Based on radio waves received by the antenna device 1, a signal on the low frequency side or a signal on the high frequency side is output from DUP 16. The signal on the low frequency side is transmitted to the system section 17 for signal-processing. The signal on the high frequency side is transmitted to the system section 18 for signal processing.

The communication apparatus as shown in FIG. 8B is a typical one for use in the case where the above DUP 16 is not employed. Here, two types of antennas, each having one transmission-reception frequency band, for use on the high and low frequency sides are provided. The low frequency side antenna is connected directly to the low frequency side system section 17, while the high frequency side antenna is connected directly to the high frequency side system section 18.

In the third embodiment, the second feeding electrode 15 is provided in addition to the feeding electrode 5, as described above. The antenna device 1 of the third embodiment can be mounted onto both of the communication apparatuses of FIGS. 8A and 8B.

In particular, in the case where the antenna device 1 of FIG. 7 is mounted onto the communication apparatus of FIG. 8A, the feeding electrode 5 of the antenna device 1 shown in FIG. 7, the feeding electrode 5 of the antenna device 1 is connected to the low and high frequency side system sections 17 and 18 through DUP 16, while the second feeding electrode 15 is not connected to the system section 17 nor the system section 18, that is, the second feeding electrode 5 is not connected to either of them, and is in the non-use state. In other words, the feeding electrode 5 functions as a sharing feeding electrode for the patch type radiation electrode 3, the first microstrip type radiation electrode 11, and the second microstrip type radiation electrode 12.

On the other hand, in the case where the antenna device 1 of FIG. 7 is mounted to the communication apparatus shown in FIG. 8B, the feeding electrode 5 of the antenna device 1 is connected to the low frequency side system section 17, and the second feeding electrode 15 is connected to the high frequency side system section 18, as shown by the dotted lines in FIG. 8B. That is, the feeding electrode 5 functions as a sharing feeding electrode for the first and second microstrip type radiation electrodes 11 and 12. The second feeding electrode 15 functions as a feeding electrode for the feeding electrode for the patch type radiation electrode.

In the third embodiment, the second feeding electrode 15 is provided in addition to the configuration of each of the above-described embodiments. Therefore, the antenna device 1 can be mounted onto not only the communication apparatus shown in FIG. 8A but also one shown in FIG. 8B excluding DUP 16. In other words, even in the communication apparatus excluding DUP 16, it is sufficient to mount only one antenna device. Accordingly, the communication apparatus can be miniaturized or simplified.

In the case where the antenna device 1 has the configuration in which transmission-reception of radio waves in three different frequency bands can be performed (that is, such a configuration as in the second embodiment), the above-described DUP 16 can be excluded by providing three feeding electrodes, that is, the feeding electrode for the batch type radiation electrode 3, the feeding electrode for the first microstrip type radiation electrode 11, and the feeding electrode for the second microstrip type radiation electrode 12, and moreover, the antenna device can be mounted onto the communication apparatus which can perform communication in three different frequency bands.

(Fourth Embodiment)

Hereinafter, a fourth embodiment will be described. In the description of the fourth embodiment, similar parts in this embodiment and the above-described embodiments are designated by the same reference numerals, and the repeated description is omitted.

In the fourth embodiment, characteristically, the patch type radiation electrode 3 in the antenna device of the first embodiment forms a degeneracy separation configuration as shown in FIGS. 9A and 9B. That is, the patch type radiation electrode 3 has such a shape that the diagonal-line resonance vectors $\alpha$ and $\beta$ have different lengths, as shown in FIG. 9A, and performs degeneracy and separation. Thereby, the patch type radiation electrode 3 carries out the transmission-reception of circular polarized radio waves. Various degeneracy separation configurations are available. Needless to say, the patch type radiation electrode 3 is not limited to the forms shown in FIGS. 9A and 9B.

In this embodiment, the patch type radiation electrode 3, having a degeneracy separation configuration, performs transmission-reception of circular polarized radio waves, and the respective microstrip type radiation electrodes 11 and 12 perform transmission-reception of linear polarized radio waves. As described above, the antenna device 1 is formed, in which transmission-reception of two types of polarized waves, that is, a circularly polarized wave and a linearly polarized wave can be performed.

(Fifth Embodiment)

Hereinafter, a fifth embodiment will be described. In the fifth embodiment, a communication apparatus using each of the above-described antenna devices is exhibited. This communication apparatus is a radio or cellular telephone 30 for mobile communication, as shown in FIG. 10. A mounting substrate 32 having a predetermined circuit is contained in a case 31 for the radio 30. In the radio 30, characteristically, any one of the antenna devices 1 of the above-described first to fourth embodiments is mounted to a mounting substrate 32.

DUP 16, the low frequency side system section 17, and the high frequency side system section 18 are formed on the mounting substrate 32 of the radio 30, as shown in FIG. 10. The antenna device 1, when it is mounted onto the mounting substrate 32, is connected to the low and high frequency side system sections 17 and 18 via DUP 16. In the radio 30, transmission-reception of radio waves in two different frequency bands is enabled only by mounting one antenna device 1.

In this embodiment, the radio 30 is equipped with the antenna device 1 having the especial configuration exhibited in each of the above-described embodiments. Therefore, transmission-reception of radio waves in two different frequency bands can be performed only by mounting one antenna device 1. Furthermore, the symmetry of the directivity of the patch type radiation electrode 3 is good. Thus, the communication apparatus has a high reliability on the antenna characteristic.

In the radio 30 shown in FIG. 10, as an example, DUP 16 is provided. When the antenna device 1 having the feeding electrode 5 and the second feeding electrode 15 is applied as described in the third embodiment, the above DUP 16 can be omitted as in the third embodiment.

(Sixth Embodiment)

Hereinafter, a sixth embodiment will be described. In this embodiment, characteristically, a first microstrip type radiation electrode group 20 and a second microstrip type radiation electrode group 21 each composed of plural microstrip type radiation electrodes are formed on both sides of the patch type radiation electrode 3. In this case, the first and second microstrip type radiation electrode groups 20 and 21 are formed substantially symmetrically with respect to the patch type radiation electrode 3.

By appropriately setting the resonance frequencies of the plural microstrip type radiation electrodes constituting the respective microstrip type radiation electrode groups 20 and 21, utilizing such properties as described in the second embodiment, various developments can be achieved, that is, transmission-reception of radio waves in at least three frequency bands can be enabled, in other words, multi functions can be rendered. In addition, the frequency band can be widened by producing multi-, e.g., double or triple-resonance state, and so forth.

If lots of microstrip type radiation electrodes constitute the first and second microstrip type radiation electrode groups 20 and 21, respectively, and the microstrip type radiation electrodes are fine in size, the numbers of the microstrip type radiation electrodes constituting the first and second microstrip type radiation electrode groups 20 and 21, respectively, do not need to be strictly equal.

(Seventh Embodiment)

Hereinafter, a seventh embodiment will be described. In this embodiment, characteristically, the dielectric substrate 2, which is similar to the dielectric substrate described in the first to sixth embodiments, has a columnar shape as shown in FIG. 12. In this case, similarly to the above embodiments, the patch type radiation electrode 3 is formed in the center of the upper face 2*a* of the dielectric substrate 2. The first and second microstrip type radiation electrodes 11 and 12 are formed on both sides of the patch type radiation electrode 3. In this case, the symmetry of the directivity of the patch type radiation electrode 3 can be also enhanced similarly to the above embodiments.

(Eighth Embodiment)

Hereinafter, an eighth embodiment will be described. FIG. 13A shows an antenna device according to an eighth embodiment which is mounted onto a mounting substrate.

FIG. 13B shows the antenna device of FIG. 13A in the developed state. In the description of this embodiment, similar parts in this embodiment and the above-described embodiments are designated by the same reference numerals. The repeated description of the parts are omitted.

The antenna device of this embodiment has a configuration in which the microstrip type radiation electrodes 11 and 12 are formed on both sides of the patch type radiation electrode 3 at a predetermined interval between the electrodes 11 and 12 and the electrode 3. The antenna device 1 has such a frequency characteristic as shown in FIG. 14A., and is configured so that transmission-reception of radio waves in three different frequency bands can be performed. The patch type radiation electrode 3 which resonates at $\lambda/2$ is formed so as to have a resonance frequency f1, the first microstrip type radiation electrode which resonates at $\lambda/4$ is formed so as to have a resonance frequency f11 lower than the resonance frequency f1, and the second microstrip type radiation electrode 12 which resonates at $\lambda/4$ is formed so as to have a resonance frequency f12 lower than the resonance frequency f11, respectively.

Most characteristically, the antenna device 1 of this embodiment has a configuration in which a signal is supplied from the feeding electrode 5 to only one of the two microstrip type radiation electrodes 11 and 12 (in this embodiment, the second microstrip type radiation electrode 12 in the right-hand side of FIG. 13), and to the other microstrip type radiation electrode 11, a power (signal) is supplied from the second microstrip type radiation electrode 12 through magnetic field coupling.

In particular, as shown in FIGS. 13A and 13B, the patch type radiation electrode 3 is formed substantially in the center of the upper face 2*a* of the dielectric substrate 2. The microstrip type radiation electrodes 11 and 12 are arranged substantially symmetrically with respect to the patch type radiation electrode 3 on both of the right and left sides thereof at an interval between the electrodes 11 and 12 and the electrode 3.

One end side of the second microstrip type radiation electrode 12 is formed so as to elongate from the upper face 2*a* onto the side face (front side face) 2*b*, bend and elongate along the upper side of the side face 2*b* toward the feeding electrode 5 in the center of the side face 2*b*. The elongated top 12*a* of the second microstrip type radiation electrode 12 forms an open end. The open end 12*a* is arranged at an interval between the ends 12*a* and the feeding electrode 5. That is, in this example, the second microstrip type radiation electrode 12 is a $\lambda/4$ microstrip type radiation electrode of an electric field coupling feeding type with which a signal is supplied from the feeding electrode 5 through a capacitance, namely, electric field coupling.

In the second microstrip type radiation electrode 12, as shown in FIG. 13B, the end opposite to the open end 12*a* is formed so as to elongate from the upper face 2*a* toward the under face 2*f* via the side face (back side face) 2*d*, and is connected to the ground electrode 7 on the under face 2*f*. The end 12*b* of the second microstrip type radiation electrode 12 connected to the ground electrode 7 constitutes a ground short-circuited portion.

Meanwhile, one end side 11*a* of the first microstrip type radiation electrode 11 provided on the left side of the patch type radiation electrode 3 constitutes an open end. The other end side is formed so as to elongate from the upper face 2*a* onto the back side face 2*d*, bend, further elongate along the upper side of the back side face 2*d* toward the second microstrip type radiation electrode 12, bend toward the under face 2*f* in the vicinity of the second microstrip type radiation electrode 12, and elongate to be connected to the ground electrode 7 on the under face 2*f*. The end 11*b* of the first microstrip type radiation electrode 11 connected to the ground electrode 7 constitutes a ground short-circuited portion.

In this embodiment, as shown in FIG. 13B, the portion of the first microstrip type radiation electrode 11 in which high frequency current is concentrated (that is, the ground short-circuited side portion), and the portion of the first microstrip type radiation electrode 12 in which high frequency current is concentrated (that is, the ground short-circuited side portion) are arranged substantially in parallel to each other at a fine interval. Therefore, the ground short-circuited side portion of the first microstrip type radiation electrode and the ground short-circuited side portion of the second microstrip type radiation electrode are magnetic field coupled, and constitutes a magnetic coupling feeding portion 43.

The magnetic coupling feeding portion 43 has the configuration in which a signal is supplied from the second microstrip type radiation electrode 12 to the first microstrip type radiation electrode 11 through magnetic coupling. The first microstrip type radiation electrode 11 constitutes a /4 microstrip type radiation electrode of a magnetic field coupling feeding type.

As described above, in the case where the magnetic field coupling feeding portion 43 is formed, matching of the first microstrip type radiation electrode 11 can be adjusted by use of a magnetic coupling degree between the microstrip type radiation electrodes 11 and 12. The magnetic field coupling degree between the microstrip type radiation electrodes 11 and 12 can be appropriately set by adjusting the interval between the ground short-circuited side portions of the microstrip type radiation electrodes 11 and 12.

In this embodiment, the feeding electrode 5 has a configuration in which power is supplied to the patch type radiation electrode 3 and the second microstrip type radiation electrode 12 through a capacitance, that is, electric field coupling. Accordingly, matching of the patch type radiation electrode 3 can be performed by adjustment of the capacitance between the feeding electrode 5 and the patch type radiation electrode 3. Matching of the second microstrip type radiation electrode can be performed by adjustment of the capacitance between the feeding electrode 5 and the second microstrip type radiation electrode 12.

Accordingly, in this embodiment, capacitance Cg1 between the patch type radiation electrode 3 and the feeding electrode 5, and the capacitance Cg2 between the second microstrip type radiation electrode 12 and the feeding electrode 5 are preset so that matching of the patch type radiation electrode 3 and matching of the second microstrip type radiation electrode 12 get to have a predetermined condition, respectively. The shape and arrangement position of the feeding electrode 5 are determined so that the predetermined capacitances Cg1 and Cg2 can be obtained.

The antenna device 1 is mounted in a predetermined area of the mounting substrate 45 with the under face 2*f* of the dielectric substrate 2 being used as a mounting surface. The feeding electrode 5 is connected to the signal supply 8 via a wiring pattern 47 and a through-hole 48 formed in the mounting substrate 45. A ground electrode 46 equivalent to the ground electrode 7 is formed in an area different from the area in which the wiring pattern 47 is formed. When the antenna device 1 is mounted in the predetermined area of the mounting substrate 45, the ground electrode 7 on the under face 2*f* of the dielectric substrate 2 is connected to the ground electrode 46. Thereby, the fixing electrodes 6, and the ground short-circuited portions 11*b* and 12*b* of the microstrip type radiation electrodes 11 and 12 are connected to the ground electrode 46 to be short-circuited to the ground. The respective patterns of the ground electrode 7 and the ground electrode 46 are designed so that the feeding electrode 5 is not short-circuited to the ground electrode 46.

In the above-described mounting-state, when power is supplied from the signal supply 8 to the feeding electrode 5, a signal caused by the power is fed from the feeding electrode 5 to the patch type radiation electrode 3 and the second microstrip type radiation electrode 12 through a capacitance, that is, electric field coupling. Then, the signal is supplied to the first microstrip type radiation electrode 11 through the magnetic field coupling feeding portion 43. In the above-described feeding route, the patch type radiation electrode 3, and the microstrip type radiation electrodes 11 and 12 are excited, respectively, so that transmission-reception of radio waves in three frequency bands is carried out.

In this embodiment, the first and second microstrip type radiation electrodes 11 and 12 short-circuited to the ground, respectively, are formed on both sides of the patch type radiation electrode 3, in substantially symmetrical positions with respect to the center of the patch type radiation electrode 3 at a predetermined interval between the electrodes 11 and 12 and the electrode 3. Therefore, the influences of the respective microstrip type radiation electrodes 11 and 12 over the directivity of a radio wave from the patch type radiation electrode 3 are substantially equal to each other on the right and left sides of the patch type radiation electrode 3. Thus, the directivity of the patch type radiation electrode 3 can be made symmetrical substantially securely.

Moreover, since one of the microstrip type radiation electrodes 11 and 12 is a $\lambda/4$ microstrip type radiation electrode of an electric field coupling feeding type, and the other is a $\lambda/4$ microstrip type radiation electrode of a magnetic field coupling feeding type, the radiation electrodes to which signals are supplied from the feeding electrode 5 through a capacitance that is, by electric field coupling, are two radiation electrodes, that is, the patch type radiation electrode 3 and the second microstrip type radiation electrode 12. Therefore, regarding the design of the feeding electrode 5, the feeding electrode 5 can be designed so that matching of these two radiation electrodes 3 and 12 is obtained, irrespective of matching of the first microstrip type radiation electrode 11. Thereby, the design of the feeding electrode 5 can be considerably easily performed, as compared with, e.g., a configuration in which signals are supplied, from the feeding electrode 5 to the three radiation electrodes 3, 11, and 12. Accordingly, the time required for the design of the feeding electrode 5 can be significantly reduced, and the design can be quickly made to correspond to modification of the specifications and so forth.

In this embodiment, matching of the radiation electrodes 3 and 12 can be easily optimized. Moreover, matching of the first microstrip type radiation electrode 11 can be optimized, independently of the radiation electrodes 3 and 12. Accordingly, as a whole, matching of the radiation electrodes 3, 11, and 12 can be securely optimized.

The antenna device 1 has such a configuration 30 as to exhibit three frequency bands as shown in FIG. 14A. For example, when the frequency band is desired to be widened, the antenna device 1 is configured so that the microstrip type radiation electrodes 11 and 12 get into the resonance state, as shown in FIG. 14B, and thereby, transmission-reception of radio waves in two frequency bands can be performed.

For example, the above resonance state can be produced by changing the shapes of the ground short-circuited side portions of the microstrip type radiation electrodes 11 and 12, shown in FIG. 13 to the shapes shown in the modified example of FIG. 15. In particular, in the configuration shown in FIG. 15, the length of the first microstrip type radiation electrode 11 is smaller, and that of the second microstrip type radiation electrode 12 is larger as compared with those of the configuration shown in FIG. 13. Thereby, the resonance frequency f11 of the first microstrip type radiation electrode 11 is varied in the decreasing direction, and the resonance frequency f12 of the second microstrip type radiation electrode 12 is varied in the increasing direction. The resonance frequencies of the microstrip type radiation electrodes 11 and 12 approach each other, producing the double resonance state as shown in FIG. 14B. For adjustment of the resonance frequencies f11 and f12 of the microstrip type radiation electrodes 11 and 12, various techniques as described above may be adopted.

In this embodiment, the resonance frequency f11 of the first microstrip type radiation electrode 11 is set to be higher than the resonance frequency f12 of the second microstrip type radiation electrode 12. The antenna device 1 may be configured so that the resonance frequency f11 of the first microstrip type radiation electrode 11 is lower than the resonance frequency f12 of the second microstrip type radiation electrode 12. That is, the resonance frequencies f1, f11, and f12 of the patch type radiation electrode 3 and the microstrip type radiation electrodes 11 and 12 are specified in specifications or the like, respectively, and should be set, if necessary. The antenna device 1 is not limited to the frequency characteristic illustrated in FIG. 14A. A variety of frequency characteristics can be adopted.

(Ninth Embodiment)

Hereinafter, a ninth embodiment will be described. In the description of the ninth embodiment, similar parts in this embodiment and the above-described embodiments are designated by the same reference numerals, and the repeated description of the parts is omitted.

FIG. 16A shows the antenna device of this embodiment and the mounting structure of the antenna. FIG. 16B is a greatly enlarged view of the area surrounded by dotted line T in FIG. 16A. Moreover, FIG. 17 shows the antenna device of FIG. 16A in the development state.

In this embodiment, characteristically, the ground short-circuited side portion of the second microstrip type radiation electrode 12 is not directly short-circuited to ground, but is high-frequency short-circuited to ground through an inductance component 50 and the ground short-circuited side portion of the first microstrip type radiation electrode 11. The other configurations of this embodiment are substantially the same as those of the above-described eighth embodiment.

That is, in this embodiment, as shown in FIG. 17, the ground short-circuited side end 12*b* of the second microstrip type radiation electrode 12 is formed so as to elongate from the back side face 2*d* of the dielectric substrate 2 onto the under face 2*f*. On the under face 2*f*, the ground electrode 7 is formed so as to avoid the end 12*b*.

Moreover, as shown in FIG. 16, a wiring pattern 51 is formed on a mounting substrate 45 for the antenna device 1 to be mounted onto, in the position thereof which comes into contact with the ground short-circuited side portion 12*b* of the second microstrip type radiation electrode 12 when the antenna device 1 is mounted in a predetermined area of the mounting substrate 45. The ground electrode 46 of the mounting substrate 45 is formed at a predetermined interval between the electrode 46 and the wiring pattern 51. Thus, the wiring pattern 51 is in the separation state with respect to ground.

That is, the ground short-circuited side end 12*b* of the second microstrip type radiation electrode 12 is formed so as not to be short-circuited directly to the ground electrode 46 which is equivalent to ground. Regarding the first microstrip type radiation electrode 11, the ground short-circuited side end 11*b* is connected to the ground electrode 46 by mounting the antenna device 1 onto the mounting substrate 45.

Moreover, in this embodiment, an inductor pattern (meander pattern) 50, which is an inductance component, is formed on the back side face 2*d* of the dielectric substrate 2, as shown in FIGS. 16A and 16B, and FIG. 17. The ground short-circuited side portion of the first microstrip type radiation electrode 11 and the ground short-circuited side portion of the second microstrip type radiation electrode 12 are connected to each other via the inductor pattern 50. That is, the ground short-circuited side portion of the second microstrip type radiation electrode 12 is high-frequency short-circuited to ground through the inductor pattern 50 and the ground short-circuited side portion of the first microstrip type radiation electrode 11.

In this embodiment, since the ground electrode short-circuited side portion of the second microstrip type radiation electrode 12 of an electric field coupling feeding type is short-circuited to ground through the inductor pattern 50, and the ground short-circuited side portion of the first microstrip type radiation electrode 11 is of a magnetic field coupling feeding type, the magnetic field coupling degree between the microstrip type radiation electrodes 11 and 12 can be changed by adjusting the inductance of the inductor pattern 50, so the matching of the first microstrip type radiation electrode 11 can be adjusted. Here, since the inductance of the inductor pattern 50 can be easily changed, matching of the first microstrip type radiation electrode 11 can be conveniently performed.

Furthermore, in this embodiment, the inductor pattern 50 is formed as an inductance component. For example, a chip inductance part may be provided instead of the inductor pattern 50.

(Tenth Embodiment)

Hereinafter, a tenth embodiment will be described. FIG. 18A shows the antenna device of the tenth embodiment and the mounting structure of the antenna. FIG. 18B is a greatly enlarged view of the area surrounded by dotted line Z in FIG. 18A. In the description of the tenth embodiment, similar parts in this embodiment and the above-described embodiments are designated by the same reference numerals, and the repeated description of the parts is omitted.

In this embodiment, characteristically, the antenna device has a configuration in which the ground short-circuited side portions of the microstrip type radiation electrodes 11 and 12 are connected to each other via an inductance portion on the mounting substrate 45, not on the dielectric substrate 2.

That is, in this embodiment, the ground short-circuited side portion 12*b* of the second microstrip type radiation electrode 12 of the electric field coupling feeding type is formed so as to elongate from the back side face 12*b* of the dielectric substrate 2 and bend onto the under face 2*f*. The ground electrode 7 on the under face 2*f* is formed at a predetermined distance to the end 12*b*.

Furthermore, on the mounting substrate 45, the wiring pattern 51 similar to that of the ninth embodiment is formed as shown in FIGS. 18A and 18B. That is, on the mounting substrate 45, the wiring pattern 51 is formed in the position where the wiring pattern 51 comes into contact with the ground short-circuited side portion of the second microstrip type radiation electrode 12 when the antenna device 1 is mounted onto the mounting substrate 45. The ground electrode 46 of the mounting substrate 45 is formed with a predetermined spacing between electrode 46 and the wiring pattern 51.

In this embodiment, the chip inductance part 52, which is the inductance portion, is formed so as to extend over the ground electrode 46 and the wiring pattern 51. Thereby, in the state in which the antenna device 1 is mounted in a set mounting area of the mounting substrate 45, the ground short-circuited side portion of the second microstrip type radiation electrode 12 is connected to the wiring pattern 51, and the second microstrip type radiation electrode 12 is high-frequency short-circuited to the ground via the wiring pattern 51 and the chip inductance part 52.

That is, the ground short-circuited side portion of the second microstrip type radiation electrode 12 is short-circuited to ground via the chip inductance part 52. In particular, similarly to the ninth embodiment, by setting the inductance of the chip inductance part 52, the magnetic field coupling degree between the microstrip type radiation electrodes 11 and 12 can be adjusted, so that matching of the first microstrip type radiation electrode 11 can be optimized. Accordingly, matching of the first microstrip type radiation electrode 11 can be easily optimized by selecting the appropriate one from chip inductance parts having different inductances.

Moreover, in this embodiment, the wiring pattern 51 and the ground electrode 46 are connected to each other via the chip inductance part 52. An inductor pattern may be formed, which is an inductance portion for connecting the wiring pattern 51 and the ground electrode 46 to each other.

(Eleventh Embodiment)

Hereinafter, an eleventh embodiment will be described. In this embodiment, characteristically, the patch type radiation electrode 3, which is similar to that of the antenna device of the eighth embodiment, has a degeneracy separation configuration as shown in FIG. 19A. That is, as shown in FIG. 19A, the patch type radiation electrode 3 has the shape in which the diagonal line resonance vectors $\alpha$ and $\beta$ have different lengths, and is configured so that transmission-reception of circular polarized radio waves can be performed. The degeneracy separation configuration is not limited to the form shown in FIG. 19A. For example, the configuration shown in FIG. 19B may be employed.

(Twelfth Embodiment)

Hereinafter, a twelfth embodiment will be described. In this embodiment, characteristically, the dielectric substrate 2, which is similar to that of the eighth embodiment 2, has a columnar shape as shown in FIG. 20. Also in this case, the patch type radiation electrode 3 is formed substantially in the center of the upper face 2*a* of the dielectric substrate 2, and the microstrip type radiation electrodes 11 and 12 are formed on both sides of the patch type radiation electrode 3 at a predetermined interval, respectively. One (the second microstrip type radiation electrode 12 in FIG. 20) of these $\lambda/4$ microstrip type radiation electrodes 11 and 12 is an electric field coupling feeding type, and the other (the first microstrip type radiation electrode 11 in FIG. 8) is a magnetic field coupling feeding type. Such configuration has the advantages that matching of the radiation electrodes 3, 11, and 12 can be easily optimized, and moreover, the reliability of the antenna characteristic can be enhanced.

(Thirteenth Embodiment)

Hereinafter, a thirteenth embodiment will be described. With reference to FIGS. 21A and 21B, in this embodiment, characteristically, wiring patterns 60 and 61 connected to the ground short-circuited side portions of the microstrip type radiation electrodes 11 and 12, respectively, are formed on the mounting substrate 45. That is, the magnetic field coupling feeding portion 43 can be formed on the mounting substrate 45 by arranging the ground short-circuited side portions of the wiring patterns 60 and 61 substantially in parallel to each other at a predetermined interval.

Furthermore, as shown in the modified example of FIG. 22, the wiring patterns 60 and 61 connected to the ground short-circuited side portions of the microstrip type radiation electrodes 11 and 12 may be formed on the mounting substrate 45, and the wiring patterns 60 and 61 are connected to each other via the inductor pattern 50 formed on the mounting substrate 45. In this case, the wiring pattern 61 connected to the first microstrip type radiation electrode 11 is configured so that the pattern 61 is not short-circuited directly to the ground.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An antenna device comprising a dielectric substrate, a patch radiation electrode separated from ground and formed on a surface of the dielectric substrate, first and second microstrip radiation electrodes formed on the substrate on respective sides of the patch radiation electrode at predetermined intervals therefrom, and short-circuited to ground, and at least one feeding electrode for feeding power to the patch radiation electrode, the first microstrip radiation electrode, and the second microstrip radiationelectrode are formed on a common surface of the dielectric substate; the patch radiation electrode, the first microstrip radiation electrode and the second microstrip radiation electrode being respectively separated from each other on the common surface.

2. The antenna device of claim 1, wherein the first microstrip radiation electrode and the second microstrip radiation electrode are arranged substantially symmetrically with respect to the patch radiation electrode.

3. The antenna device of claim 2, wherein the first microstrip radiation electrode and the second microstrip radiation electrode have different resonance frequencies.

4. The antenna device of claim 1, wherein the first microstrip radiation electrode and the second microstrip radiation electrode have different resonance frequencies.

5. The antenna device of claim 4, wherein the first microstrip radiation electrode and the second microstrip radiation electrode have a double resonance state.

6. The antenna device of claim 1, wherein the patch radiation electrode has a degeneracy separation configuration.

7. The antenna device of claim 1, wherein the dielectric substrate has a feeding electrode for feeding power to the patch radiation electrode, and further, a feeding electrode for feeding power to both of the first microstrip radiation electrode and the second microstrip radiation electrode.

8. The antenna device of claim 1, wherein the dielectric substrate has a feeding electrode for feeding power to the patch radiation electrode, a feeding electrode for feeding power to the first microstrip radiation electrode, and a feeding electrode for feeding power to the second microstrip radiation electrode, independently.

9. The antenna device of claim 1, wherein at least one microstrip radiation electrode is provided in the vicinity of and in parallel to the first microstrip radiation electrode to form a first microstrip radiation electrode group, and at least one microstrip radiation electrode is provided in the vicinity of and in parallel to the second microstrip radiation electrode to form a second microstrip radiation electrode group.

10. The antenna device of claim 9, wherein the first microstrip radiation electrode group and the second microstrip radiation electrode group are arranged substantially symmetrically with respect to the patch radiation electrode.

11. The antenna device of claim 9, wherein the first microstrip radiation electrode group and the second microstrip radiation electrode group have different resonance frequencies.

12. The antenna device of claim 1, wherein the dielectric substrate has a feeding electrode for feeding power to both the patch radiation electrode and the second microstrip radiation electrode, and a magnetic field coupling feeding portion for feeding power from the second microstrip radiation electrode to the first microstrip radiation electrode via magnetic coupling.

13. The antenna device of claim 12, wherein the magnetic field coupling feeding portion comprises a ground short-circuited side portion of the first microstrip radiation electrode and a ground short-circuited side portion of the second microstrip radiation electrode arranged substantially in parallel to each other at a predetermined interval.

14. The antenna device of claim 12, wherein the magnetic field coupling feeding portion has a configuration in which a ground short-circuited side portion of the first microstrip radiation electrode and a ground short-circuited side portion of the second microstrip radiation electrode are connected to each other via an inductance component.

15. The antenna device of claim 14, wherein the magnetic field coupling portion is formed on a surface of the dielectric substrate.

16. The antenna device of claim 14, wherein the dielectric substrate is provided on a mounting substrate, and the magnetic field coupling feeding portion is formed on the mounting substrate.

17. The antenna device of claim 1, wherein the dielectric substrate has a first face provided with the patch radiation electrode, the first microstrip radiation electrode, and the second microstrip radiation electrode, a second face provided with a ground connection, and side faces connecting the first face and the second face to each other.

18. The antenna device of claim 17, wherein the feeding electrode is formed on a side face of the dielectric substrate.

19. A communication apparatus comprising at least one of a transmitter and receiver circuit, and further comprising an antenna device coupled to the at least one of the transmitter and receiver circuit, the antenna device comprising a dielectric substrate, a patch type radiation electrode separated from ground and formed on a surface of the dielectric substrate, first and second microstrip radiation electrodes formed on the substrate on respective sides of the patch radiation electrode at predetermined intervals therefrom, and short-circuited to ground, and at least one feeding electrode for feeding power to the patch radiation electrode, the first microstrip radiation electrode, and the second microstrip radiation electrode via a capacitance; and further wherein the patch radiation electrode, the first microstrip radiation and the second microstrip radiation electrode are formed on a common surface of the dielectric substrate; the patch radiation electrode, the first microstrip radiation electrode and the second microstrip radiation electrode being respectively separated from each other on the common surface.

20. The communication apparatus of claim 19, wherein the first microstrip radiation electrode and the second microstrip radiation electrode are arranged substantially symmetrically with respect to the patch radiation electrode.

21. The communication apparatus of claim 20, wherein the first microstrip radiation electrode and the second microstrip radiation electrode have different resonance frequencies.

22. The communication apparatus of claim 19, wherein the first microstrip radiation electrode and the second microstrip radiation electrode have different resonance frequencies.

23. The communication apparatus of claim 22, wherein the first microstrip radiation electrode and the second microstrip radiation electrode have a double resonance state.

24. The communication apparatus of claim 19, wherein the patch radiation electrode has a degeneracy separation configuration.

25. The communication apparatus of claim 19, wherein the dielectric substrate has a feeding electrode for feeding power to the patch radiation electrode, and further, a feeding electrode for feeding power to both of the first microstrip radiation electrode and the second microstrip radiation electrode.

26. The communication apparatus of claim 19, wherein the dielectric substrate has a feeding electrode for feeding power to the patch radiation electrode, a feeding electrode for feeding power to the first microstrip radiation electrode, and a feeding electrode for feeding power to the second microstrip radiation electrode, independently.

27. The communication apparatus of claim 19, wherein at least one microstrip radiation electrode is provided in the vicinity of and in parallel to the first microstrip radiation electrode to form a first microstrip radiation electrode group, and at least one microstrip radiation electrode is provided in the vicinity of and in parallel to the second microstrip radiation electrode to form a second microstrip radiation electrode group.

28. The communication apparatus of claim 27, wherein the first microstrip radiation electrode group and the second microstrip radiation electrode group are arranged substantially symmetrically with respect to the patch radiation electrode.

29. The communication apparatus device of claim 27, wherein the first microstrip radiation electrode group and the second microstrip radiation electrode group have different resonance frequencies.

30. The communication apparatus of claim 19, wherein the dielectric substrate has a feeding electrode for feeding power to both the patch radiation electrode and the second microstrip radiation electrode, and a magnetic field coupling feeding portion for feeding power from the second microstrip radiation electrode to the first microstrip radiation electrode via magnetic coupling.

31. The communication apparatus of claim 30, wherein the magnetic field coupling feeding portion comprises a ground short-circuited side portion of the first microstrip radiation electrode and a ground short-circuited side portion of the second microstrip radiation electrode arranged substantially in parallel to each other at a predetermined interval.

32. The communication apparatus of claim 30, wherein the magnetic field coupling feeding portion has a configuration in which a ground short-circuited side portion of the first microstrip radiation electrode and a ground short-circuited side portion of the second microstrip radiation electrode are connected to each other via an inductance component.

33. The communication apparatus of claim 32, wherein the magnetic field coupling portion is formed on a surface of the dielectric substrate.

34. The communication apparatus of claim 32, wherein the dielectric substrate is provided on a mounting substrate, and the magnetic field coupling feeding portion is formed on the mounting substrate.

35. The communication apparatus of claim 19, wherein the dielectric substrate has a first face provided with the patch radiation electrode, the first microstrip radiation electrode, and the second microstrip radiation electrode, a second face provided with a ground connection, and side faces connecting the first face and the second face to each other.

36. The communication apparatus of claim 35, wherein the feeding electrode is formed on a side face of the dielectric substrate.

* * * * *